US008913922B2

(12) United States Patent
Arikawa et al.

(10) Patent No.: US 8,913,922 B2
(45) Date of Patent: Dec. 16, 2014

(54) IMAGE FORMING APPARATUS, FIXING-SECTION-HOLDING MECHANISM, AND FIXING DEVICE

(75) Inventors: Kiichirou Arikawa, Kanagawa (JP); Masami Ishida, Kanagawa (JP); Shigeru Watanabe, Kanagawa (JP); Yoshiro Konishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 13/594,263

(22) Filed: Aug. 24, 2012

(65) Prior Publication Data

US 2013/0259527 A1 Oct. 3, 2013

(30) Foreign Application Priority Data

Mar. 29, 2012 (JP) ..... 2012-077926

(51) Int. Cl.
*G03G 15/20* (2006.01)

(52) U.S. Cl.
CPC ..... *G03G 15/2071* (2013.01); *G03G 15/2017* (2013.01); *G03G 15/2035* (2013.01)
USPC ..... 399/122

(58) Field of Classification Search
CPC ..... G03G 15/2015; G03G 15/2071; G03G 15/2017; G03G 21/1638; G03G 21/1647; G03G 15/2035
USPC ..... 399/122
See application file for complete search history.

(56) References Cited

U.S. PATENT DOCUMENTS

| | | | | |
|---|---|---|---|---|
| 6,909,866 | B2 * | 6/2005 | Kawai | 399/167 |
| 7,263,313 | B2 * | 8/2007 | Kim et al. | 399/167 |
| 7,471,919 | B2 * | 12/2008 | Kawakami et al. | 399/167 |
| 7,715,759 | B2 * | 5/2010 | Kawakami et al. | 399/167 |
| 7,911,658 | B2 * | 3/2011 | Yamamoto | 358/474 |
| 8,565,646 | B2 * | 10/2013 | Suzuki | 399/167 |
| 2007/0053712 | A1 * | 3/2007 | Fujiwara et al. | 399/88 |
| 2011/0091237 | A1 * | 4/2011 | Suzuki | 399/101 |

FOREIGN PATENT DOCUMENTS

| | | | | |
|---|---|---|---|---|
| JP | 05254691 A | * | 10/1993 | B65H 5/36 |
| JP | 07-271122 A | | 10/1995 | |
| JP | 2000-321915 A | | 11/2000 | |

* cited by examiner

*Primary Examiner* — David Gray
*Assistant Examiner* — Carla Therrien
(74) *Attorney, Agent, or Firm* — Sughrue Mion, PLLC

(57) ABSTRACT

An image forming apparatus includes an apparatus body in which an image forming section that forms an image on a recording material and a drive mechanism that generates a rotational driving force are provided; a fixing section that transports the recording material while receiving the rotational driving force and fixes the image on the recording material, the fixing section being held by the apparatus body at two axial ends thereof; and a transmission mechanism that is provided at one of the two axial ends of the fixing section and is connected to the drive mechanism, the transmission mechanism transmitting the rotational driving force from the drive mechanism to the fixing section. When a pulling force is applied to a recording material that is present in the fixing section, the drive mechanism and the transmission mechanism are disconnected from each other.

13 Claims, 15 Drawing Sheets

IMAGE FORMING APPARATUS, FIXING-SECTION-HOLDING MECHANISM, AND FIXING DEVICE

CROSS-REFERENCE TO RELATED APPLICATIONS

This application is based on and claims priority under 35 USC 119 from Japanese Patent Application No. 2012-077926 filed Mar. 29, 2012.

BACKGROUND

Technical Field

The present invention relates to an image forming apparatus, a fixing-section-holding mechanism, and a fixing device.

SUMMARY

According to an aspect of the invention, there is provided an image forming apparatus including an apparatus body in which an image forming section that forms an image on a recording material and a drive mechanism that generates a rotational driving force are provided; a fixing section that transports the recording material while receiving the rotational driving force and fixes the image on the recording material, the fixing section being held by the apparatus body at two axial ends thereof; and a transmission mechanism that is provided at one of the two axial ends of the fixing section and is connected to the drive mechanism, the transmission mechanism transmitting the rotational driving force from the drive mechanism to the fixing section. When a pulling force is applied to a recording material that is present in the fixing section, the drive mechanism and the transmission mechanism are disconnected from each other.

BRIEF DESCRIPTION OF THE DRAWINGS

An exemplary embodiment of the present invention will be described in detail based on the following figures, wherein:

FIGS. 5A-1, 5A-2, 5B-1, and 5B-2 illustrate the connector-side pressing member and the drive-side pressing member according to the exemplary embodiment of the present invention;

FIGS. 9A-1 to 9A-4 and 9B-1 to 9B-4 illustrate how the attaching/detaching mechanism according to the exemplary embodiment of the present invention behaves in a detaching operation;

FIGS. 10A-1 to 10A-4 and 10B-1 to 10B-4 illustrate how the attaching/detaching mechanism according to the exemplary embodiment of the present invention behaves in an attaching operation;

FIGS. 12A-1, 12A-2, 12B-1, and 12B-2 illustrate how the attaching/detaching mechanism according to the exemplary embodiment of the present invention behaves when a recording sheet is pulled out; and FIGS. 13A-1 to 13A-3 and 13B-1 to 13B-3 illustrate an attaching/detaching mechanism according to a modification of the exemplary embodiment of the present invention.

DETAILED DESCRIPTION

An exemplary embodiment of the present invention will now be described in detail with reference to the accompanying drawings.

Image Forming Apparatus 1

Figure 1:
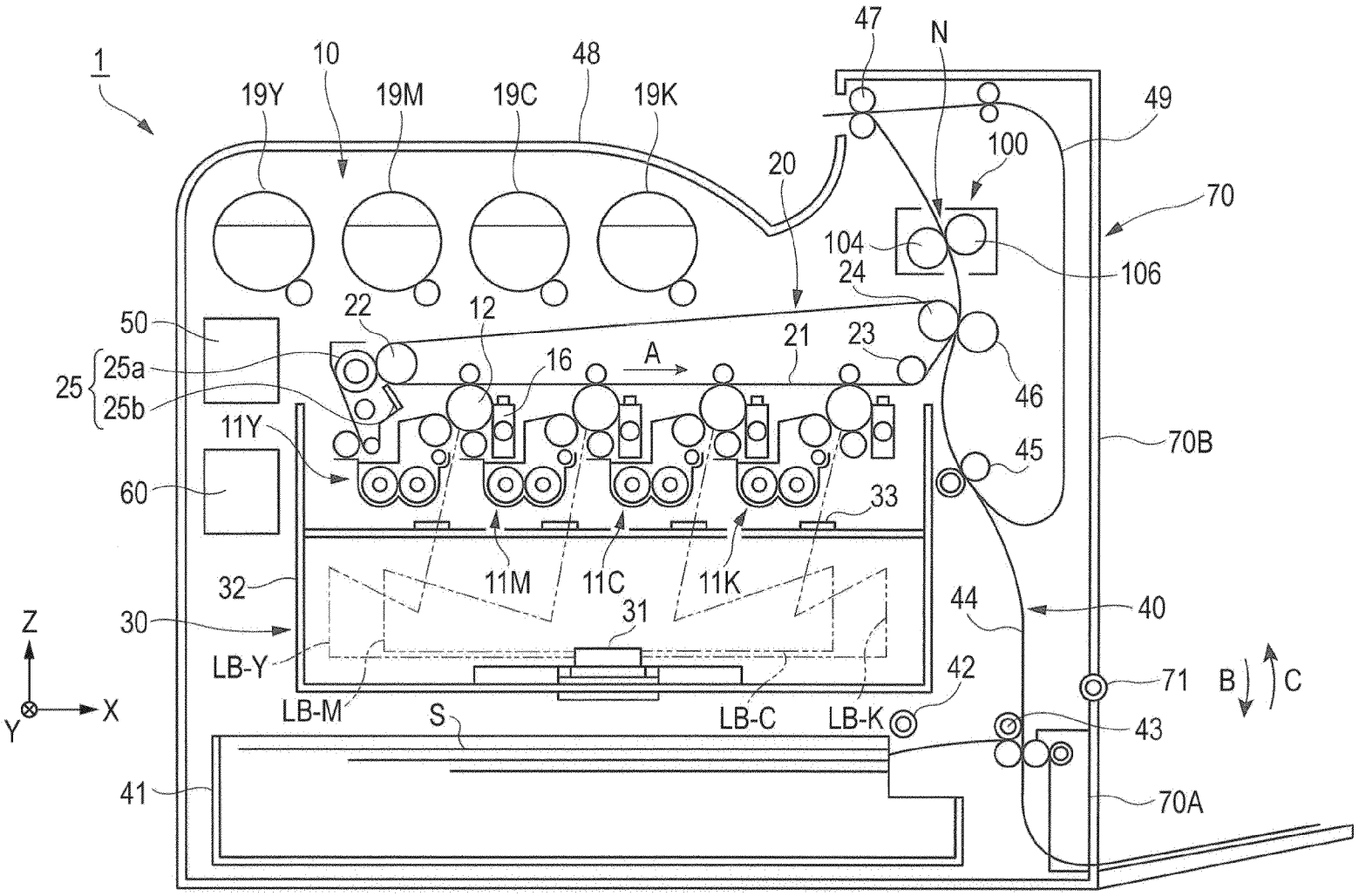
FIG. 1 illustrates an overall configuration of an image forming apparatus according to the exemplary embodiment of the present invention.

FIG. 1 illustrates an overall configuration of an image forming apparatus 1 according to an exemplary embodiment of the present invention. The image forming apparatus 1 is a so-called tandem-type digital color printer. The image forming apparatus 1 illustrated in FIG. 1 includes an image processing system 10 that performs image formation in accordance with tone data for different colors, a sheet transport system 40 that transports a recording sheet S, an image processor 50 that is connected to a device such as a personal computer or an image reading device and performs a predetermined image processing on image data received, a controller 60 that controls the entirety of the image forming apparatus 1, and a housing 70 that houses all the foregoing.

The image processing system 10, which is an exemplary image forming section, includes four image forming units 11Y, 11M, 11C, and 11K provided for different colors of yellow (Y), magenta (M), cyan (C), and black (K) and arranged in parallel and at intervals in the horizontal direction; a transfer unit 20 that multiply transfers toner images in the different colors formed on photoconductor drums 12 included in the respective image forming units 11Y, 11M, 11C, and 11K to an intermediate transfer belt 21; a scanning optical system 30 as an optical unit that applies laser beams LB-Y, LB-M, LB-C, and LB-K to the respective image forming units 11Y, 11M, 11C, and 11K; a fixing unit 100 that fixes, on the recording sheet S with heat and pressure, the toner images that have been second-transferred to the recording sheet S by the transfer unit 20; and toner cartridges 19Y, 19M, 19C, and 19K from which toners having the different colors are supplied to the respective image forming units 11Y, 11M, 11C, and 11K.

The transfer unit 20 includes a driving roller 22 that drives the intermediate transfer belt 21, which is an intermediate transfer body, a tension roller 23 that gives a certain tension to the intermediate transfer belt 21, a backup roller 24 that second-transfers the toner images in the different colors superposed one on top of another to the recording sheet S, and a cleaning device 25 that removes toner residues and the like from the intermediate transfer belt 21. The intermediate transfer belt 21 is stretched with a certain tension around the driving roller 22, the tension roller 23, and the backup roller 24 and is driven to rotate in a direction of arrow A at a predetermined speed by the driving roller 22 that is driven to rotate by a drive motor (not illustrated). The intermediate transfer belt 21 is made of, for example, a belt material (rubber or resin) that is not electrically chargeable and has an adjusted resistance. The cleaning device 25 includes a cleaning brush 25*a* and a cleaning blade 25*b* and removes toner residues, paper lint, and the like from the surface of the intermediate transfer belt 21 after the transfer of the toner images, thereby becoming ready for another image forming process.

The scanning optical system 30 includes laser diodes (LDs, not illustrated), a modulator (not illustrated), and a polygonal mirror 31 that scanningly deflects the laser beams LB-Y, LB-M, LB-C, and LB-K emitted from the respective LDs. In the configuration illustrated in FIG. 1, the scanning optical system 30 is provided below the image forming units 11Y, 11M, 11C, and 11K. Therefore, the scanning optical system 30 has a risk of contamination due to dropping of toners and the like. Hence, the scanning optical system 30 has a rectangular-parallelepiped frame 32 in which components of the scanning optical system 30 including the foregoing are tightly sealed. The frame 32 has glass windows 33 at the top thereof. The laser beams LB-Y, LB-M, LB-C, and LB-K are transmitted through the respective windows 33. Thus, scanning exposure is performable with an enhanced shielding effect.

The fixing unit 100, which is an exemplary fixing section or fixing device, includes a heat roller 104 and a pressure belt 106. The heat roller 104 includes a halogen lamp (not illustrated) provided thereinside. The pressure belt 106 is pressed against the outer circumferential surface of the heat roller 104. The heat roller 104 and the pressure belt 106 in combination nip the recording sheet S therebetween and apply heat and pressure to the recording sheet S, thereby fixing the toner images on the recording sheet S. The site where the outer circumferential surface of the heat roller 104 and the outer circumferential surface of the pressure belt 106 are pressed against each other (the site where the recording sheet S is nipped) is hereinafter referred to as nip N.

The sheet transport system 40 includes a sheet feeding device 41 that contains a stack of recording sheets S on each of which an image is to be formed, a pickup roller 42 that picks up some of the recording sheets S from the sheet feeding device 41, a feed roller 43 that separates one of the recording sheets S fed by the pickup roller 42 from the others, a transport path 44 along which the recording sheet S separated from the others by the feed roller 43 is transported toward an image transfer site, a registration roller 45 that transports, with an appropriate timing toward a second transfer position, the recording sheet S transported along the transport path 44, a second-transfer roller 46 that is provided at the second transfer position and second-transfers the toner images to the recording sheet S by being pressed against the backup roller 24, a discharge roller 47 that discharges the recording sheet S having the toner images fixed thereon by the fixing unit 100 to the outside of the housing 70, an output tray 48 onto which the recording sheet S discharged by the discharge roller 47 is stacked, and a duplex transport path 49 in which the recording sheet S that has undergone fixing performed by the fixing unit 100 is reversed for duplex recording.

The housing 70 includes a body 70A, which is an exemplary apparatus body, and a covering 70B connected to the body 70A with a hinge member 71. The body 70A and the covering 70B in combination houses the components described above. The covering 70B is openable and closable by being turned about the hinge member 71 (in directions of arrows B and C). When the covering 70B, which is an exemplary covering member, is opened, the fixing unit 100 provided in the housing 70 is exposed.

Hereinafter, the depth direction in FIG. 1 (a direction along the axis of each of the photoconductor drums 12) is referred to as Y direction, the horizontal direction (the lateral direction in FIG. 1) orthogonal to the Y direction is referred to as X direction, and the vertical direction (in FIG. 1) orthogonal to the X and Y directions is referred to as Z direction. Furthermore, a direction in which the fixing unit 100 is detached from the body 70A (a direction toward the right side in FIG. 1, which will be described separately below) is referred to as +X direction, and a direction in which the fixing unit 100 is attached to the body 70A (a direction toward the left side in FIG. 1) is referred to as −X direction. Furthermore, a direction deep into the image forming apparatus 1 in the Y direction (a direction toward the far side in FIG. 1) is referred to as +Y direction, and a direction coming out of the image forming apparatus 1 in the Y direction (a direction toward the near side in FIG. 1) is referred to as −Y direction. Furthermore, a direction toward the upper side (in FIG. 1) of the image forming apparatus 1 in the Z direction is referred to as +Z direction, and a direction toward the lower side (in FIG. 1) of the image forming apparatus 1 in the Z direction is referred to as −Z direction. Occasionally, a side of the image forming apparatus 1 on the near side (in FIG. 1) is simply referred to as connector side, and a side of the image forming apparatus 1 on the far side (in FIG. 1) is simply referred to as drive side.

An operation performed by the image forming apparatus 1 illustrated in FIG. 1 will now be described. An optical image as a reflection from colorants on a piece of document read by a document reading device (not illustrated) or color image data created by a personal computer or the like (not illustrated) is input as reflectance data for, for example, red (R), green (G), and blue (B) into the image processor 50. The image processor 50 performs, on the reflectance data thus input thereto, predetermined image processing operations including image editing, such as shading correction, misregistration correction, brightness/color-space conversion, gamma correction, frame erasing, color editing, and image moving. The image processor 50 converts the data processed as described above into four pieces of color tone data corresponding to yellow (Y), magenta (M), cyan (C), and black (K) and outputs the four pieces of color tone data to the scanning optical system 30.

The scanning optical system 30 applies the laser beams LB-Y, LB-M, LB-C, and LB-K emitted from the LDs (not illustrated) in accordance with the pieces of color tone data received to the polygonal mirror 31 via an f-θ lens (not illustrated). The laser beams LB-Y, LB-M, LB-C, and LB-K applied to the polygonal mirror 31 are modulated in accordance with the pieces of tone data for the respective colors and are scanningly deflected toward the photoconductor drums 12 of the respective image forming units 11Y, 11M, 11C, and 11K via an imaging lens and plural mirrors (both not illustrated). The surfaces of the photoconductor drums 12 included in the image forming units 11Y, 11M, 11C, and 11K that have been charged in advance are scanningly exposed to the respective laser beams LB-Y, LB-M, LB-C, and LB-K, whereby electrostatic latent images are formed on the respective photoconductor drums 12. The electrostatic latent images are developed into toner images in the colors of yellow (Y), magenta (M), cyan (C), and black (K) in the image forming units 11Y, 11M, 11C, and 11K, respectively. The toner images formed on the photoconductor drums 12 of the image forming units 11Y, 11M, 11C, and 11K are multiply transferred to the intermediate transfer belt 21.

Meanwhile, in the sheet transport system 40, the pickup roller 42 rotates in accordance with the timing of image formation, and some of the recording sheets S of a predetermined size are picked up from the sheet feeding device 41. One of the recording sheets S thus picked up is separated from the others by the feed roller 43, is transported along the transport path 44, and is temporarily stopped at the registration roller 45. Subsequently, the registration roller 45 rotates in accordance with the timing of rotation of the intermediate transfer belt 21 having the toner images, whereby the recording sheet S is transported to the second transfer position defined between the backup roller 24 and the second-transfer roller 46. The toner images in the four respective colors that are superposed one on top of another are transferred to the recording sheet S, which is transported from the lower side toward the upper side through the second transfer position, in a sub-scanning direction with a certain pressure and a predetermined electric field.

Subsequently, the recording sheet S having the toner images in the respective colors undergoes a fixing process in which heat and pressure are applied to the recording sheet S by the fixing unit 100. Then, the discharge roller 47 discharges the recording sheet S onto the output tray 48, which is provided at the top of the housing 70. According to need, the direction of transport of the recording sheet S that has undergone the fixing process performed by the fixing unit 100 may be switched by a switching gate (not illustrated) so that the recording sheet S is not immediately discharged onto the output tray 48 but is reversed in the duplex transport path 49. In that case, the recording sheet S that has been reversed is transported to the registration roller 45, and another image is formed on the other side of the recording sheet S through the series of operations described above. Thus, images are formed on both sides of the recording sheet S.

Attaching/Detaching Mechanism 110

Figure 2A:
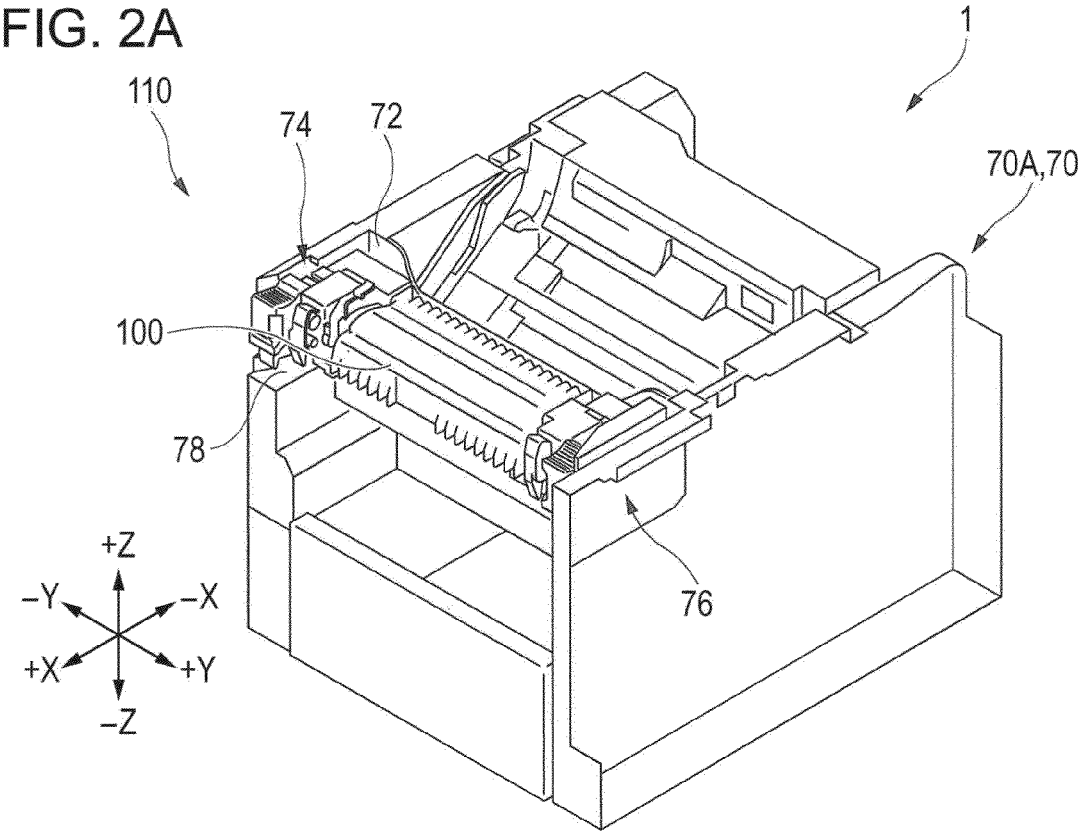
FIGS. 2A and 2B illustrate a fixing unit and a body of the image forming apparatus according to the exemplary embodiment of the present invention that are in an attached state and in a detached state, respectively.
Figure 2B:
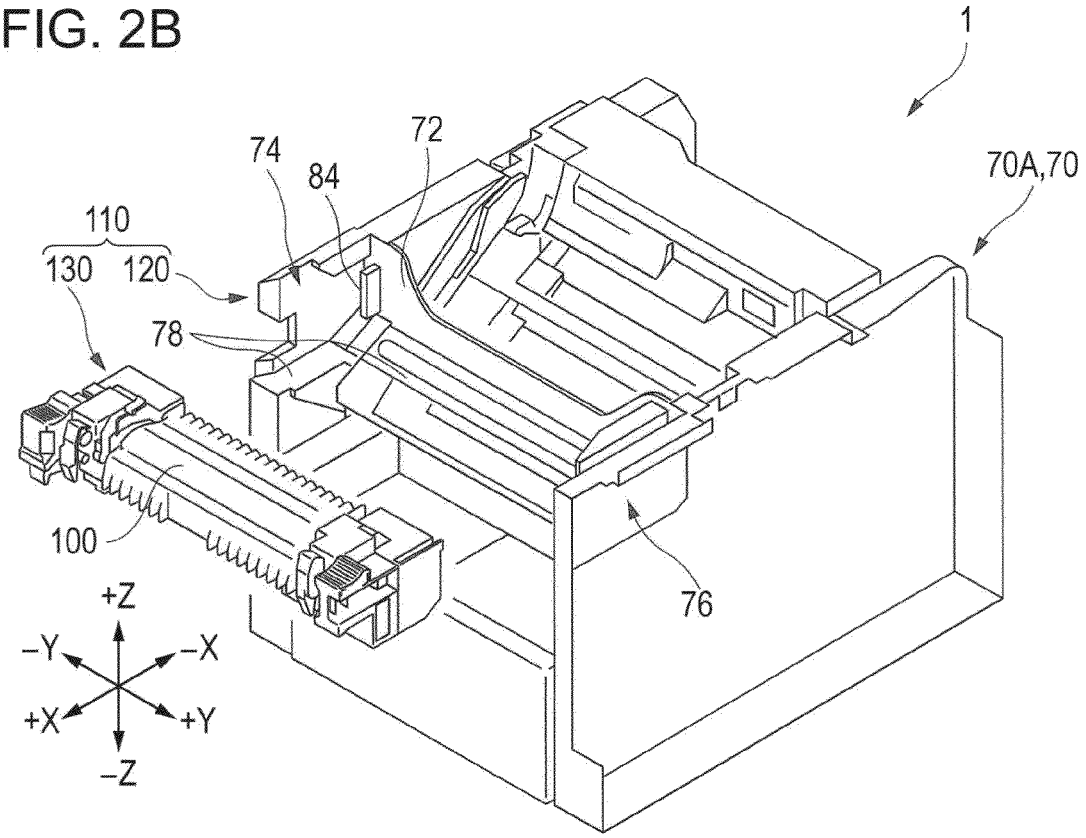

FIGS. 2A and 2B illustrate the fixing unit 100 and the body 70A according to the exemplary embodiment of the present invention that are in an attached state and in a detached state, respectively. FIG. 2A illustrates the attached state where the fixing unit 100 is set in the body 70A. FIG. 2B illustrates the detached state where the fixing unit 100 has been detached from the body 70A. For easy understanding, components including the covering 70B and the output tray 48 are not illustrated in FIGS. 2A and 2B.

Figure 3A:
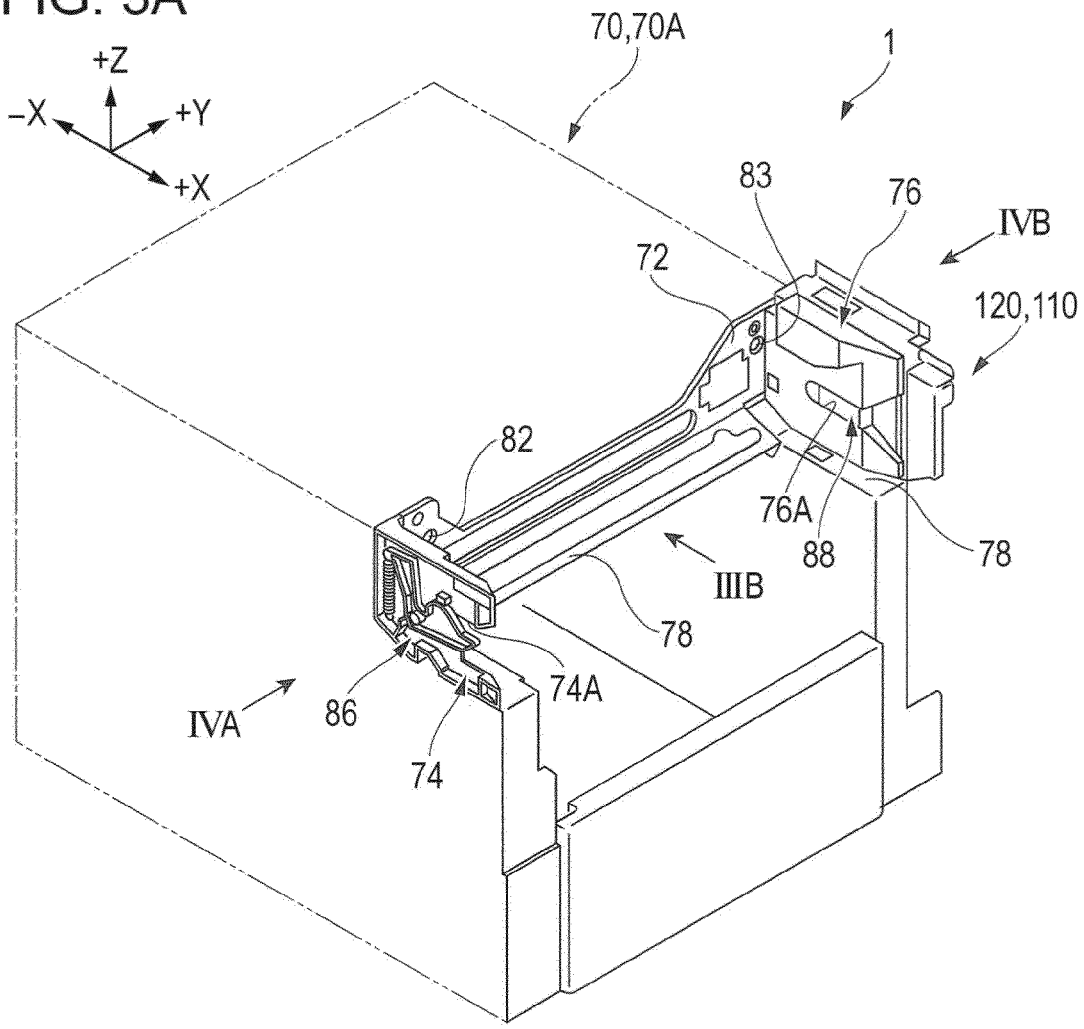
FIGS. 3A and 3B illustrate a body-side mechanism included in an attaching/detaching mechanism according to the exemplary embodiment of the present invention.
Figure 3B:
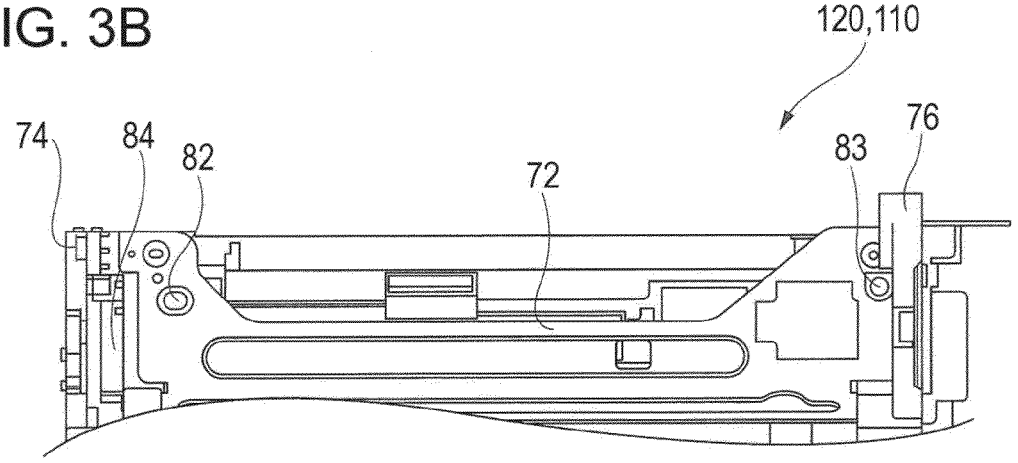

FIGS. 3A and 3B illustrate a body-side mechanism 120 included in an attaching/detaching mechanism 110 according to the exemplary embodiment of the present invention. FIG. 3A is a perspective view of the body-side mechanism 120 included in the attaching/detaching mechanism 110. FIG. 3B illustrates a positioning plate 72 and associated components seen in a direction of arrow 111B illustrated in FIG. 3A.

Referring to FIGS. 2A and 2B, the image forming apparatus 1 according to the exemplary embodiment includes the attaching/detaching mechanism 110 that allows the fixing unit 100 to be attached to and detached from the body 70A. With the attaching/detaching mechanism 110, the fixing unit 100 is attachable to the body 70A (the state illustrated in FIG. 2A) and is detachable from the body 70A (the state illustrated in FIG. 2B).

Referring to FIG. 2B, the attaching/detaching mechanism 110 includes the body-side mechanism 120 provided on the body 70A and a fixing-unit-side mechanism 130 provided on the fixing unit 100. The attachment and detachment of the fixing unit 100 are realized by the engagement and disengagement between the body-side mechanism 120 and the fixing-unit-side mechanism 130 of the attaching/detaching mechanism 110. Description of the body-side mechanism 120 will be provided below first, followed by description of the fixing-unit-side mechanism 130.

Body-Side Mechanism 120

The body-side mechanism 120 will now be described.

Referring to FIG. 2B, the body-side mechanism 120 includes the following: the positioning plate 72 that faces the leading side of the fixing unit 100 in an attaching direction (the −X direction) in which the fixing unit 100 is attached to the body 70A, side plates 74 and 76 (to be described below) provided at the −Y-direction end and at the +Y-direction end, respectively, of the positioning plate 72 and supporting the positioning plate 72, a guide plate 78 projecting in the +X direction from the lower end of the positioning plate 72, a connector 84 (to be described below) projecting in the +X direction from the −Y-direction end of the positioning plate 72 and via which power is supplied to the fixing unit 100 and signals are transmitted to and from the fixing unit 100, a connector-side pressing member 86 (to be described below, see FIG. 4A) and a drive-side pressing member 88 (to be described below, see FIG. 4B) supported by the respective side plates 74 and 76 and that apply pressing forces acting in the −X direction to the fixing unit 100, and a driving gear 92 (see FIG. 4B) that is an exemplary drive mechanism or drive unit and transmits a driving force generated by a drive source (not illustrated) to the fixing unit 100.

Referring to FIGS. 3A and 3B, the positioning plate 72 has an oblong hole 82 at the −Y-direction end thereof. The longitudinal direction of the oblong hole 82 corresponds to the Y direction. The positioning plate 72 also has an opening 83 at the +Y-direction end thereof.

Referring to FIG. 3A, the guide plate 78 is connected to the positioning plate 72. The guide plate 78 guides the movement of the fixing unit 100 in the X direction and supports the fixing unit 100 that has been set in the body 70A, as described below.

Side Plates 74 and 76

The side plates 74 and 76 will now be described with reference to FIGS. 4A and 4B.

Figure 4A:
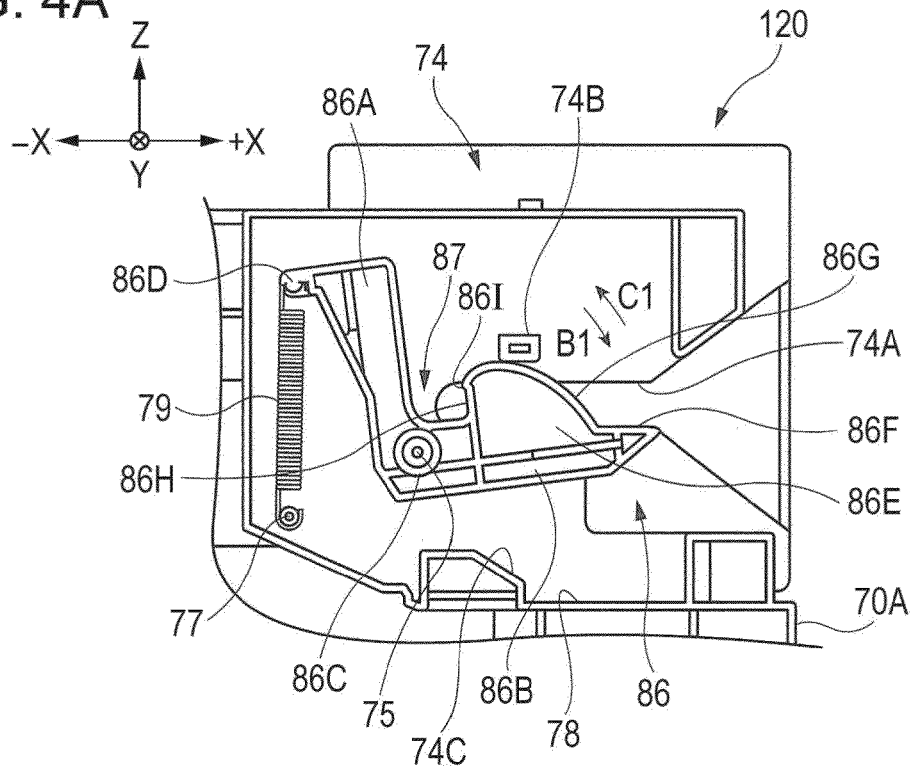
FIGS. 4A and 4B illustrate side plates, a connector-side pressing member, a drive-side pressing member, and associated components according to the exemplary embodiment of the present invention.
Figure 4B:
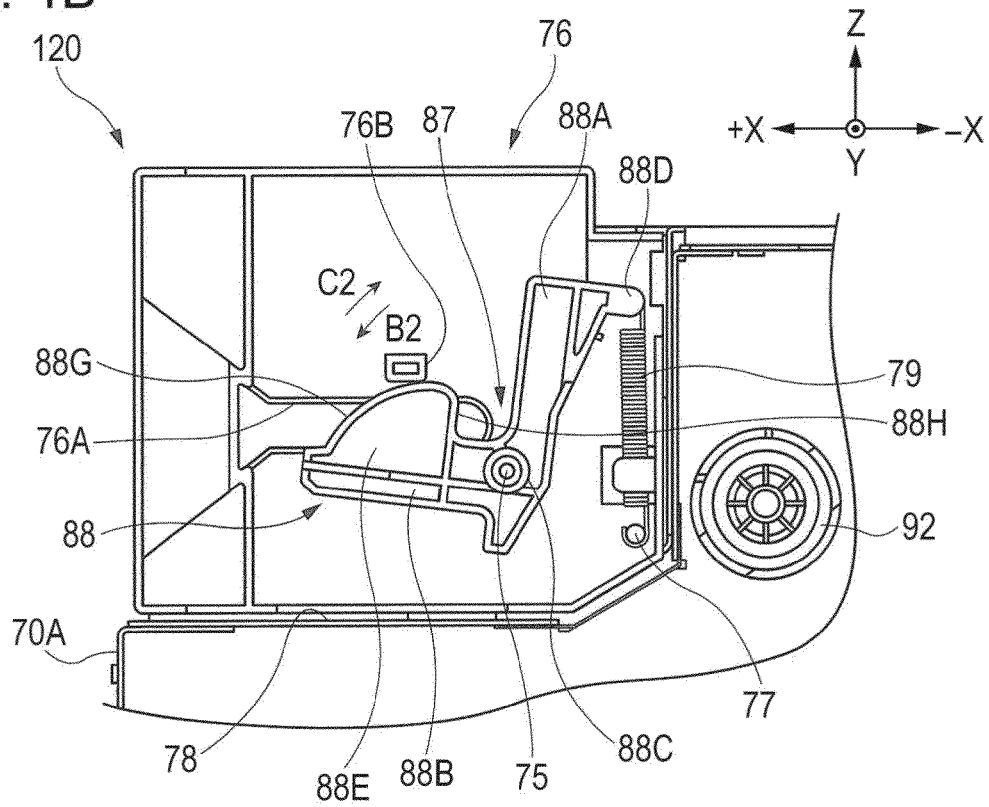

FIGS. 4A and 4B illustrate the side plates 74 and 76, the connector-side pressing member 86, the drive-side pressing member 88, and associated components according to the exemplary embodiment of the present invention. FIG. 4A is a side view seen in a direction of arrow IVA illustrated in FIG. 3A. FIG. 4B is a side view seen in a direction of arrow IVB illustrated in FIG. 3A.

The side plate 74 provided on the connector side of the image forming apparatus 1 will first be described.

Referring to FIG. 4A, the side plate 74 includes a cut portion 74A extending from the +X-direction end thereof and whose longitudinal direction corresponds to the X direction, a first stopper 74B and a second stopper 74C both projecting in the −Y direction from a surface thereof, a pin 75 and a hook 77 both projecting in the −Y direction from the surface thereof, and a tension spring 79 a first end of which is hooked over the hook 77.

The cut portion 74A has a Z-direction size that allows a guide pin 122 (to be described below, see FIGS. 6A and 6B) provided on the fixing unit 100 to be inserted thereinto and to be guided therealong in the X direction.

The first stopper 74B and the second stopper 74C limit the range of rotational movement of the connector-side pressing member 86, which will be described below.

The connector-side pressing member 86 is rotatably supported by the pin 75, as described below. In the configuration illustrated in FIG. 4A, the hook 77 resides on the −X-direction side with respect to the pin 75.

The tension spring 79 has the first end thereof hooked over the hook 77 and a second end thereof hooked over an end of the connector-side pressing member 86.

The side plate 76 provided on the drive side of the image forming apparatus 1 will now be described.

Referring to FIG. 4B, the side plate 76 has almost the same configuration as the side plate 74 and includes a cut portion 76A extending from the +X-direction end thereof and whose longitudinal direction corresponds to the X direction, a first stopper 76B projecting in the +Y direction from a surface thereof, a pin 75 and a hook 77 both projecting in the +Y direction from the surface thereof, and a tension spring 79 a first end of which is hooked over the hook 77. The cut portion 76A has a Z-direction size that allows a guide pin 123 (to be described below, see FIGS. 7A and 7B) provided on the fixing unit 100 to be inserted thereinto and to be guided therealong in the X direction. The side plate 76 does not include a member corresponding to the second stopper 74C provided on the side plate 74. All the foregoing members have the same configurations as those of the side plate 74, and detailed description thereof is omitted.

Connector-Side Pressing Member 86 and Drive-Side Pressing Member 88

Referring now to FIGS. 4A, 4B, 5A-1, 5A-2, 5B-1, and 5B-2, the connector-side pressing member 86 and the drive-side pressing member 88 will be described.

Figures 1, 5B:
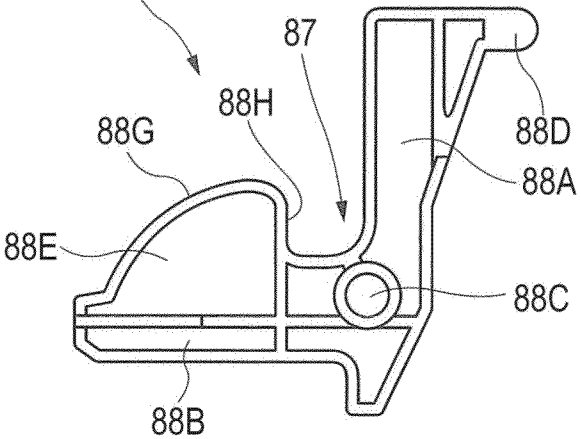
Figures 2, 5B:
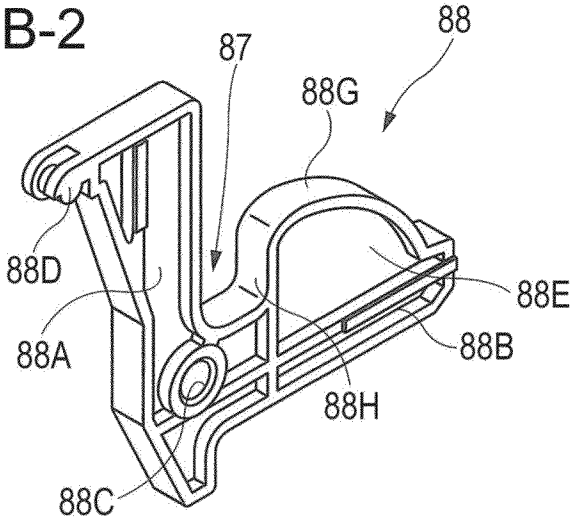
Figures 1, 5A:
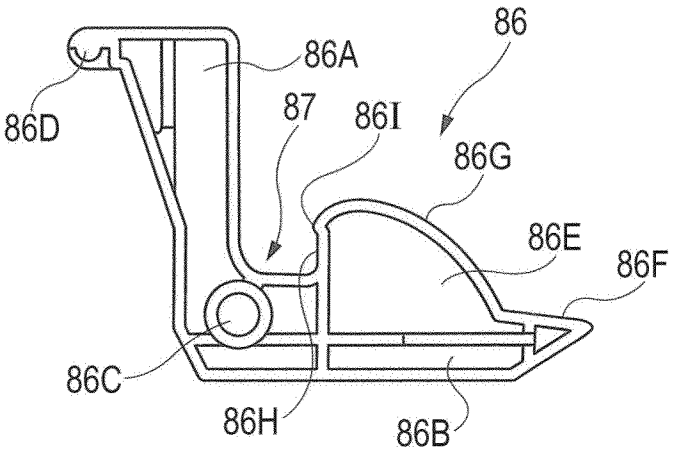
Figures 2, 5A:
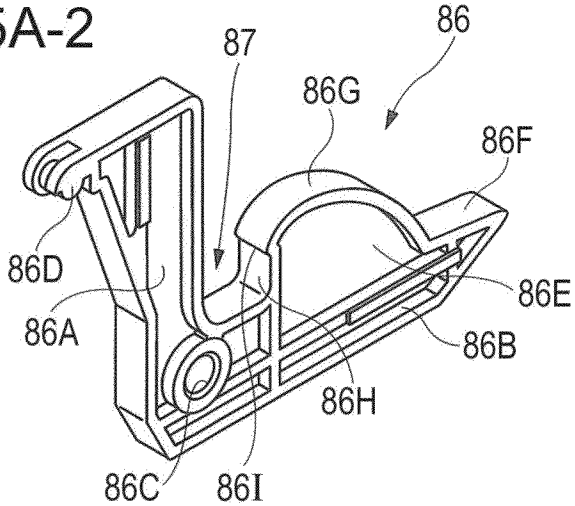

FIGS. 5A-1, 5A-2, 5B-1, and 5B-2 illustrate the connector-side pressing member 86 and the drive-side pressing member 88 according to the exemplary embodiment of the present invention. FIGS. 5A-1 and 5A-2 illustrate the connector-side pressing member 86. FIGS. 5B-1 and 5B-2 illustrate the drive-side pressing member 88.

First, the connector-side pressing member 86, which is an exemplary nondrive-side holding mechanism, will be described.

Referring to FIGS. 5A-1 and 5A-2, the connector-side pressing member 86 is an L-shaped member having a bend therein. The connector-side pressing member 86 includes a first arm 86A on one side thereof and a second arm 86B on the other side thereof. The connector-side pressing member 86 has a through hole 86C provided at the bend in the L shape thereof. Furthermore, the connector-side pressing member 86 includes a hook 86D provided at an end of the first arm 86A (an end farther from the second arm 86B) and over which the second end of the tension spring 79 is hooked, a latch 86E to be pressed by the guide pin 122 and projecting from a longitudinal central part of the second arm 86B in a direction intersecting (orthogonal to) the longitudinal direction of the second arm 86B, and a contact surface 86F provided at an end of the second arm 86B (an end farther from the first arm 86A) and with which a disabling lever 131 (see FIGS. 6A and 6B) comes into contact. The disabling lever 131 disables the connector-side pressing member 86 from pressing the fixing unit 100 in the −X direction.

The latch 86E has a guide surface 86G projecting from the second arm 86B while forming an arc. The guide pin 122 (to be described below, see FIG. 6B) of the fixing unit 100 comes into contact with the guide surface 86G. An end of the guide surface 86G nearer to the through hole 86C is continuous with a side surface 86H extending in the direction intersecting (orthogonal to) the longitudinal direction of the second arm 86B. A projection 86I projects from an end of the side surface 86H on a side adjoining the guide surface 86G. The side surface 86H, the upper surface of the second arm 86B, and the side surface of the first arm 86A define a recess 87.

A state of the connector-side pressing member 86 that is set on the side plate 74 will now be described.

Referring to FIG. 4A, the connector-side pressing member 86 is set such that the through hole 86C thereof is fitted on the pin 75 provided on the side plate 74. Therefore, the connector-side pressing member 86 is rotatable about the pin 75 (in directions of arrows B1 and C1).

The second end of the tension spring 79 is hooked over the hook 86D. The connector-side pressing member 86 is urged by the tension spring 79 in such a direction as to rotate about the pin 75 in the direction of arrow C1. The second arm 86B of the connector-side pressing member 86 is positioned between the first stopper 74B and the second stopper 74C and on the circumference of a virtual circle centered at the pin 75. In the state illustrated in FIG. 4A, the connector-side pressing member 86 that is subjected to the force exerted by the tension spring 79 and acting in such a direction as to rotate the connector-side pressing member 86 in the direction of arrow C1 is in contact with the first stopper 74B, thereby being stationary. In the state illustrated in FIG. 4A, the latch 86E resides in an area coinciding with the cut portion 74A in the Z direction.

The drive-side pressing member 88, which is an exemplary drive-side holding mechanism, will now be described.

Referring to FIGS. 5B-1 and 5B-2, the drive-side pressing member 88 has almost the same configuration as the connector-side pressing member 86. The drive-side pressing member 88 is an L-shaped member having a bend therein. The drive-side pressing member 88 includes a first arm 88A on one side thereof and a second arm 88B on the other side thereof. The drive-side pressing member 88 has a through hole 88C provided at the bend in the L shape thereof. Furthermore, the drive-side pressing member 88 includes a hook 88D provided at an end of the first arm 88A (an end farther from the second arm 88B), and a latch 88E to be pressed by the guide pin 123 and projecting from a longitudinal central part of the second arm 88B in a direction intersecting (orthogonal to) the longitudinal direction of the second arm 88B.

The latch 88E has a guide surface 88G projecting from the second arm 88B while forming an arc. The guide pin 123 (to be described below, see FIG. 7B) of the fixing unit 100 comes into contact with the guide surface 88G. An end of the guide surface 88G nearer to the through hole 88C is continuous with a side surface 88H extending in the direction intersecting (orthogonal to) the longitudinal direction of the second arm 88B. The side surface 88H, the upper surface of the second arm 88B, and the side surface of the first arm 88A define a recess 87.

The drive-side pressing member 88 does not include a member corresponding to the contact surface 86F of the connector-side pressing member 86 and a member corresponding to the projection 86I of the connector-side pressing member 86.

A state of the drive-side pressing member 88 that is set on the side plate 76 will now be described.

Referring to FIG. 4B, the drive-side pressing member 88 is set such that the through hole 88C thereof is fitted on the pin 75. Therefore, the drive-side pressing member 88 is rotatable about the pin 75 (in directions of arrows B2 and C2). The second end of the tension spring 79 is hooked over the hook 88D. The drive-side pressing member 88 is urged by the tension spring 79 in such a direction as to rotate about the pin 75 in the direction of arrow C2. In the state illustrated in FIG. 4B, the drive-side pressing member 88 that is subjected to the force exerted by the tension spring 79 and acting in such a direction as to rotate the drive-side pressing member 88 in the direction of arrow C2 is in contact with the first stopper 76B, thereby being stationary. In the state illustrated in FIG. 4B, the latch 88E resides in an area coinciding with the cut portion 76A in the Z direction.

Fixing-Unit-Side Mechanism 130

The fixing-unit-side mechanism 130 included in the attaching/detaching mechanism 110 will now be described.

Figure 6A:
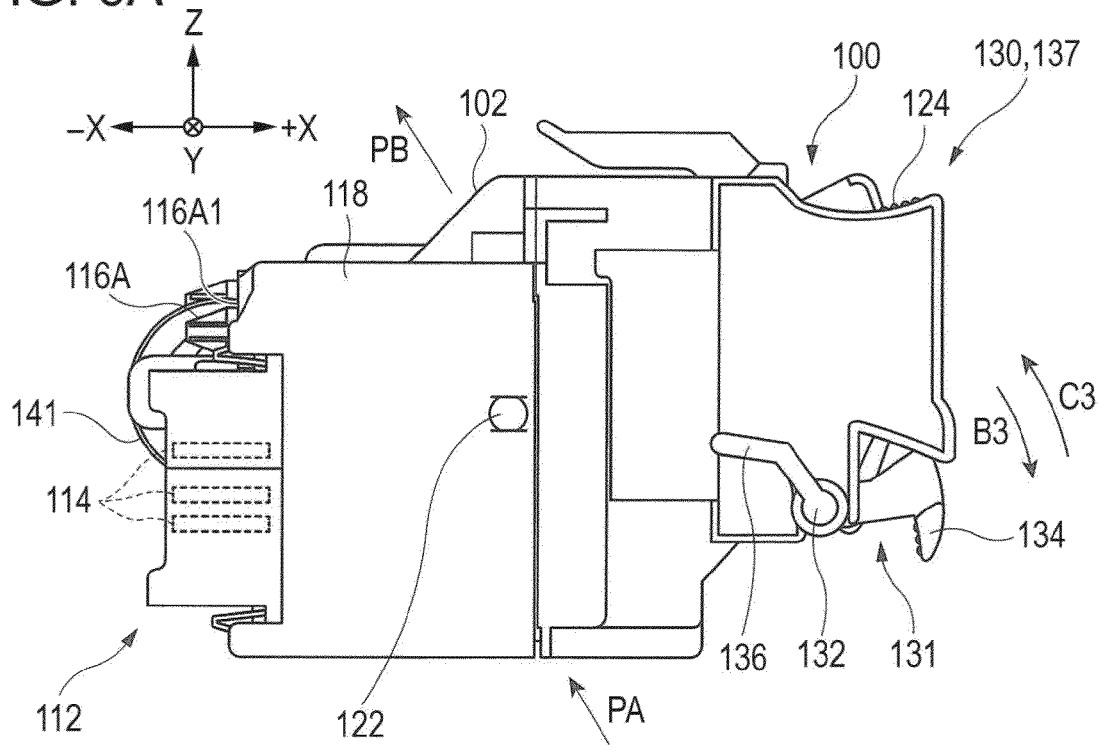
FIGS. 6A and 6B illustrate a connector side of a fixing-unit-side mechanism according to the exemplary embodiment of the present invention.
Figure 6B:
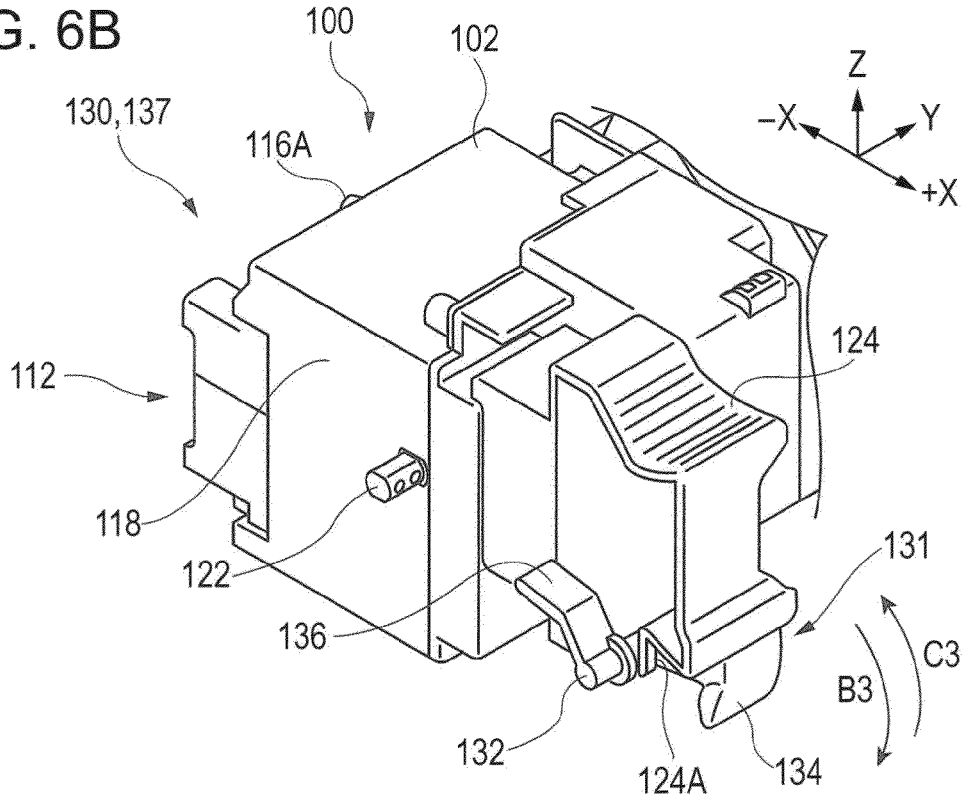
Figure 7A:
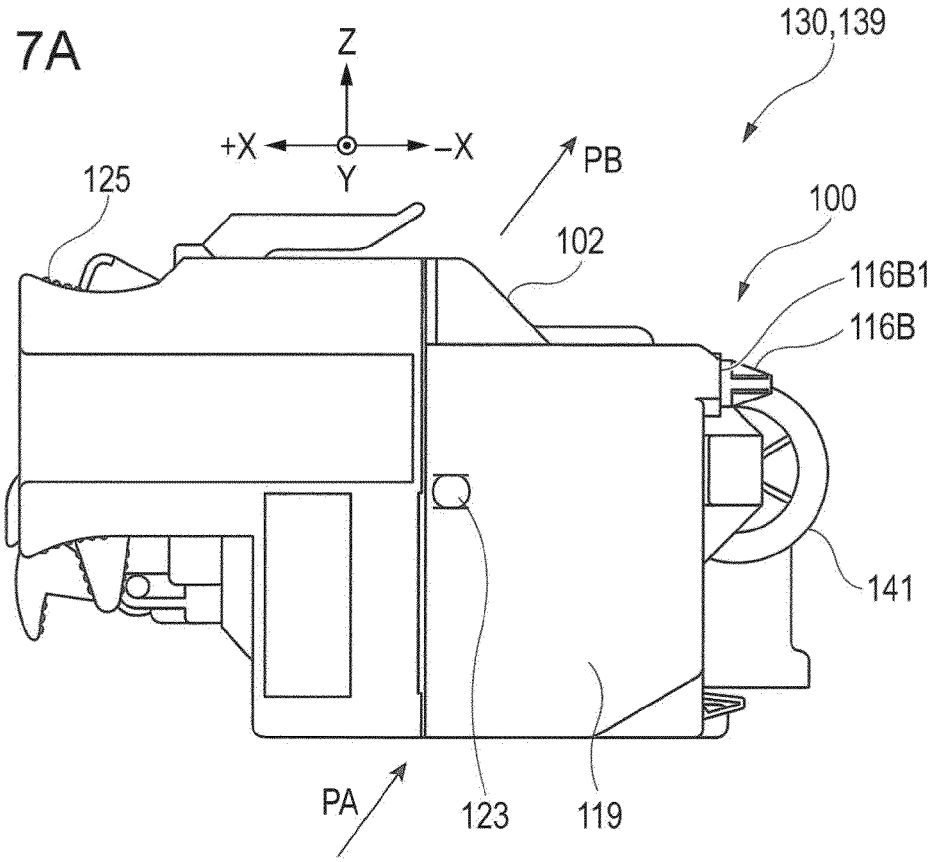
FIGS. 7A and 7B illustrate a drive side of the fixing-unit-side mechanism according to the exemplary embodiment of the present invention.
Figure 7B:
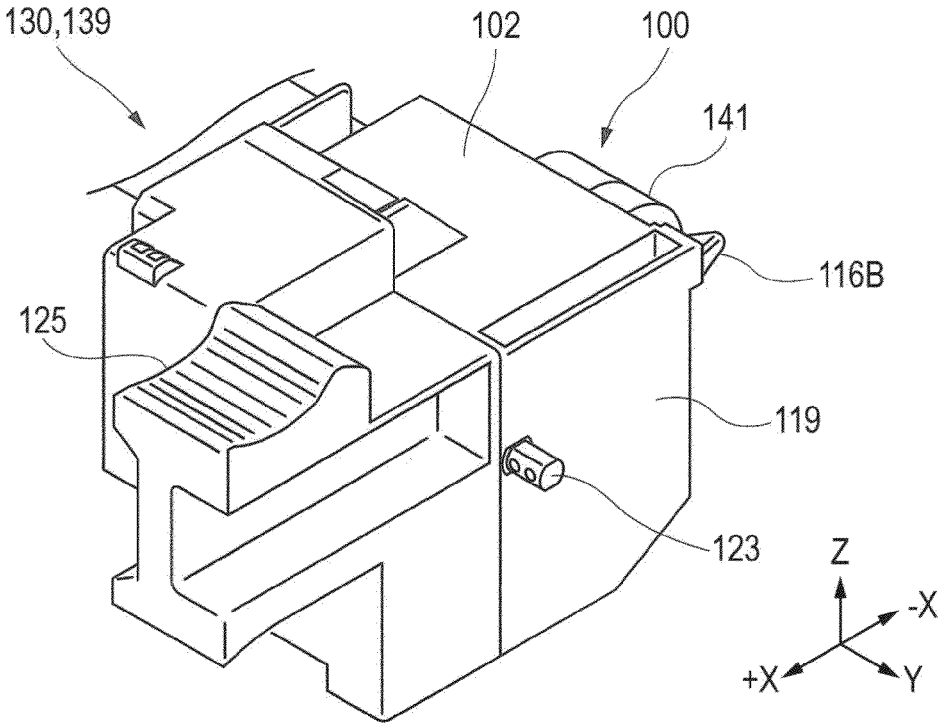

FIGS. 6A and 6B illustrate the connector side of the fixing-unit-side mechanism 130 according to the exemplary embodiment of the present invention. FIG. 6A is a side view illustrating the connector side of the fixing-unit-side mechanism 130 seen in the +Y direction. FIG. 6B is a perspective view illustrating the connector side of the fixing-unit-side mechanism 130. FIGS. 7A and 7B illustrate the drive side of the fixing-unit-side mechanism 130 according to the exemplary embodiment of the present invention. FIG. 7A is a side view illustrating the drive side of the fixing-unit-side mechanism 130 seen in the −Y direction. FIG. 7B is a perspective view illustrating the drive side of the fixing-unit-side mechanism 130.

Referring to FIGS. 6A, 6B, 7A, and 7B, the fixing-unit-side mechanism 130 includes a housing 102 that houses the fixing unit 100. The fixing-unit-side mechanism 130 further includes a connector-side member 137 provided on the connector side of the housing 102 and a drive-side member 139 provided on the drive side of the housing 102.

In the configuration illustrated in FIGS. 6A, 6B, 7A, and 7B, the housing 102 has a rectangular-parallelpiped shape whose longitudinal direction corresponds to the Y direction. The recording sheet S on which an image is to be fixed by the fixing unit 100 is transported and advances into the housing 102 (the fixing unit 100) in a direction of arrow PA and is discharged in a direction of arrow PB.

Referring to FIGS. 6A and 6B, the connector-side member 137 includes the following: a connector 112 provided at the −Y-direction end of the housing 102 and via which power is supplied from and signals are transmitted to and from the connector 84 (see FIG. 2B) of the body-side mechanism 120, a positioning pin 116A projecting from the housing 102 in the −X direction and to be fitted into the oblong hole 82 (see FIG. 3B) of the body-side mechanism 120, the guide pin 122 projecting in the −Y direction through a sidewall 118 of the housing 102 on the −Y-direction side, a grip 124 provided on the +X-direction side of the housing 102 and to be gripped by the user when the fixing unit 100 is attached to or detached from the body 70A, and the disabling lever 131 provided on the −Z-direction side of the grip 124 and disabling the connector-side pressing member 86 from pressing the fixing unit 100.

The connector 112, which is an exemplary connection terminal, is mechanically and electrically connectable to the connector 84 (see FIG. 2B) and includes feeder terminals 114 (see FIG. 6A) via which power is supplied to the halogen lamp (not illustrated) provided in the heat roller 104 (see FIG. 1).

The positioning pin 116A is of such a size as to be fitted into the oblong hole 82 (see FIG. 3B) of the body-side mechanism 120. The positioning pin 116A is prevented from moving in the Z direction within the oblong hole 82 but is movable in the Y direction within the oblong hole 82. The positioning pin 116A includes a contact surface 116A1 at the base thereof. The contact surface 116A1 is provided at such a position as to come into contact with the positioning plate 72 (see FIG. 3B) when the positioning pin 116A is fitted into the oblong hole 82. When the fixing unit 100 is attached to the body 70A, the positioning pin 116A is fitted into the oblong hole 82, whereby the fixing unit 100 is positioned.

The guide pin 122 is inserted into the cut portion 74A (see FIG. 4A) of the side plate 74, and the movement of the guide pin 122 in the X direction is limited by the connector-side pressing member 86, as described below. In the configuration illustrated in FIGS. 6A and 6B, the guide pin 122 has a substantially round columnar shape.

In the configuration illustrated in FIGS. 6A and 6B, the grip 124 is formed as a recess provided in a surface of the housing 102 on the +Z-direction side. The recess receives fingers of the user and facilitates the attaching and detaching of the fixing unit 100 to and from the body 70A.

The disabling lever 131, which is an exemplary disabling mechanism, includes a round-columnar shaft 132 whose axis extends in the Y direction and rotatably supported by the housing 102, an operated portion 134 continuous with the +Y-direction end of the shaft 132 and extending in the +X direction, and an acting portion 136 continuous with the −Y-direction end of the shaft 132 and extending in the −X direction. The shaft 132, the operated portion 134, and the acting portion 136 are provided as an integral body. The disabling lever 131 is rotatable about the shaft 132 (in directions of arrows B3 and C3).

Referring to FIGS. 7A and 7B, the drive-side member 139 includes the following: a positioning pin 116B projecting from the housing 102 in the −X direction and to be fitted into the opening 83 (see FIG. 3B) of the body-side mechanism 120, the guide pin 123 projecting in the +Y direction through a sidewall 119 of the housing 102 on the +Y-direction side, a grip 125 provided on the +X-direction side of the housing 102 and to be gripped by the user when the fixing unit 100 is attached to or detached from the body 70A, and a fixing-unit gear 141 meshing with and driven by the driving gear 92 (see FIG. 4B) of the body-side mechanism 120. The drive-side member 139 does not include the connector 112 and the disabling lever 131.

The positioning pin 116B is of such a size as to be fitted into the opening 83 (see FIG. 3B) of the body-side mechanism 120. The positioning pin 116B is prevented from moving in the Z direction within the opening 83. The movable range of the positioning pin 116B in the Y direction within the opening 83 is smaller than that of the positioning pin 116A within the oblong hole 82 (see FIG. 3B). The positioning pin 116B includes a contact surface 116B1 at the base thereof. The contact surface 116B1 is provided at such a position as to come into contact with the positioning plate 72 (see FIG. 3B) when the positioning pin 116B is fitted into the opening 83. When the fixing unit 100 is attached to the body 70A, the positioning pin 116B is fitted into the opening 83, whereby the fixing unit 100 is positioned.

The guide pin 123 is inserted into the cut portion 76A (see FIG. 4B) of the side plate 76, and the movement of the guide pin 123 in the X direction is limited by the drive-side pressing member 88, as described below. In the configuration illustrated in FIGS. 7A and 7B, the guide pin 123 has a substantially round columnar shape.

In the configuration illustrated in FIGS. 7A and 7B, the grip 125 is formed as a recess provided in a surface of the housing 102 on the +Z-direction side, as with the grip 124. The recess receives fingers of the user.

In the configuration illustrated in FIGS. 6A, 6B, 7A, and 7B, the fixing-unit gear 141, which is an exemplary transmission mechanism or transmission unit, is provided in the housing 102 with a part thereof projecting from the housing 102 in the −X direction. The fixing-unit gear 141 drives (rotates) the heat roller 104 and the pressure belt 106 (see FIG. 1) provided in the housing 102. The fixing-unit gear 141 meshes with the driving gear 92, whereby a driving force generated by the drive source (not illustrated) is transmitted to the heat roller 104 and the pressure belt 106.

Attaching/Detaching Mechanism 110 in Attached State

An attached state of the attaching/detaching mechanism 110 where the fixing unit 100 is set in the body 70A (the state illustrated in FIG. 2A) will now be descried. The attaching/detaching mechanism 110 is in the attached state when the image forming apparatus 1 (see FIG. 1) performs image formation.

Figure 8A:
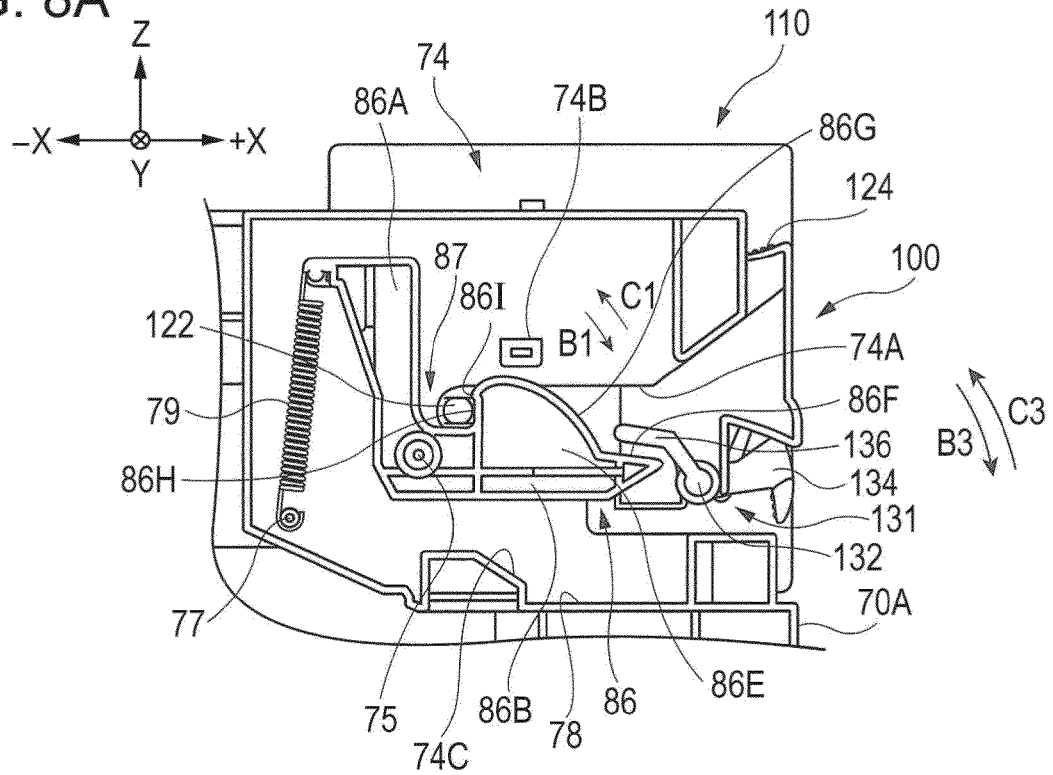
FIGS. 8A and 8B illustrate the attaching/detaching mechanism according to the exemplary embodiment of the present invention in the attached state.
Figure 8B:
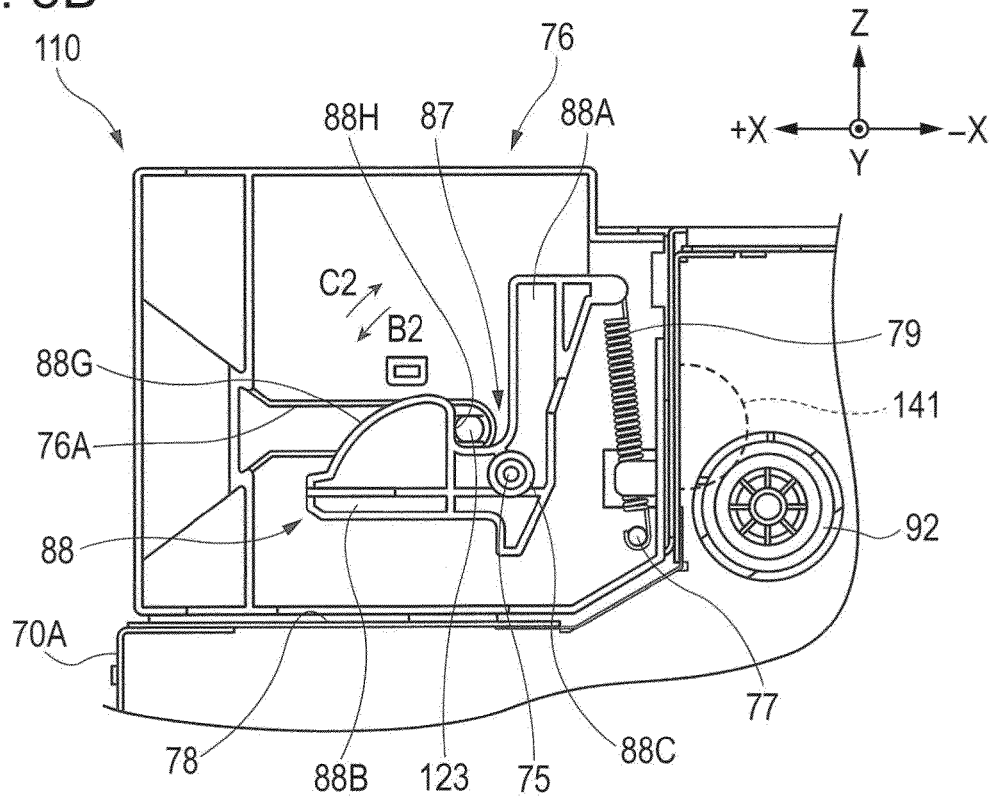

FIGS. 8A and 8B illustrate the attaching/detaching mechanism 110 according to the exemplary embodiment of the present invention in the attached state. FIG. 8A is a side view illustrating the connector side of the attaching/detaching mechanism 110 seen in the +Y direction. FIG. 8B is a side view illustrating the drive side of the attaching/detaching mechanism 110 seen in the −Y direction.

Referring to FIG. 8A, on the connector side of the attaching/detaching mechanism 110 in the attached state, the guide pin 122 of the fixing unit 100 resides in the cut portion 74A of the side plate 74 provided on the body 70A and is in contact with the side surface 86H of the connector-side pressing member 86. In this state, the connector-side pressing member 86 is urged by the tension spring 79 with a force acting in such a direction as to rotate the connector-side pressing member 86 about the pin 75 in the direction of arrow C1. Therefore, the guide pin 122 is subjected to a pressing force acting in the −X direction from the side surface 86H of the connector-side pressing member 86. That is, a force acting in such a direction as to prevent the fixing unit 100 from being detached from the body 70A (a force that retains the fixing unit 100) is applied to the fixing unit 100 by the connector-side pressing member 86.

More specifically, in the state illustrated in FIG. 8A where the guide pin 122 is in contact with the side surface 86H, the projection 86I resides at a position on the +Z-direction side with respect to the point of contact between the guide pin 122 and the side surface 86H. If the guide pin 122 tends to move in the +X direction with a force larger than the urging force exerted by the tension spring 79, the guide pin 122 pushes the side surface 86H and rotates the connector-side pressing member 86 in the direction of arrow B1. When the guide pin 122 moves along the side surface 86H while pushing the side surface 86H, the guide pin 122 comes into contact with the projection 86I. Thus, the projection 86I prevents the guide pin 122 from going over the side surface 86H and stops the rotation of the connector-side pressing member 86 in the direction of arrow B1. That is, the guide pin 122 is prevented from moving in the +X direction by the projection 86I that is present in the path of movement thereof.

In the state illustrated in FIG. 8A where the attaching/detaching mechanism 110 is in the attached state, the contact surface 86F of the connector-side pressing member 86 provided on the body 70A is spaced apart from the acting portion 136 of the disabling lever 131 provided on the fixing unit 100.

Referring now to FIG. 8B, on the drive side of the attaching/detaching mechanism 110 in the attached state, the guide pin 123 provided on the fixing unit 100 resides in the cut portion 76A of the side plate 76 provided on the body 70A and is in contact with the side surface 88H of the drive-side pressing member 88. In this state, the drive-side pressing member 88 is urged by the tension spring 79 with a force acting in such a direction as to rotate the drive-side pressing member 88 about the pin 75 in the direction of arrow C2. Therefore, the guide pin 123 is subjected to a pressing force acting in the −X direction from the side surface 88H of the drive-side pressing member 88. That is, a force acting in such a direction as to prevent the fixing unit 100 from being detached from the body 70A (a force that retains the fixing unit 100) is applied to the fixing unit 100 by the drive-side pressing member 88.

In the state illustrated in FIG. 8B where the attaching/detaching mechanism 110 is in the attached state, the driving gear 92 provided on the body 70A meshes with the fixing-unit gear 141 provided on the fixing unit 100 while the rotational axes thereof are staggered from each other in a direction (the Z direction) intersecting (orthogonal to) the direction (the +X direction) in which the fixing unit 100 is pushed into the body 70A.

The members included in the attaching/detaching mechanism 110 that is in the attached state are in the following individual states. The guide plate 78 provided on the side of the body 70A supports the housing 102 (see FIGS. 6A and 6B) provided on the side of the fixing unit 100. The connector 84 (see FIG. 2B) provided on the side of the body 70A is mechanically and electrically connected to the connector 112 (see FIG. 6A) provided on the side of the fixing unit 100. The positioning pin 116A (see FIG. 6A) provided on the side of the fixing unit 100 is in the oblong hole 82 (see FIG. 3B) provided on the side of the body 70A. The positioning pin 116B (see FIG. 7A) provided on the side of the fixing unit 100 is in the opening 83 (see FIG. 3B) provided on the side of the body 70A.

Behavior of Attaching/Detaching Mechanism 110 in Detaching Operation

How the attaching/detaching mechanism 110 behaves when the fixing unit 100 is detached from the body 70A will now be described.

Figures 1, 9B:
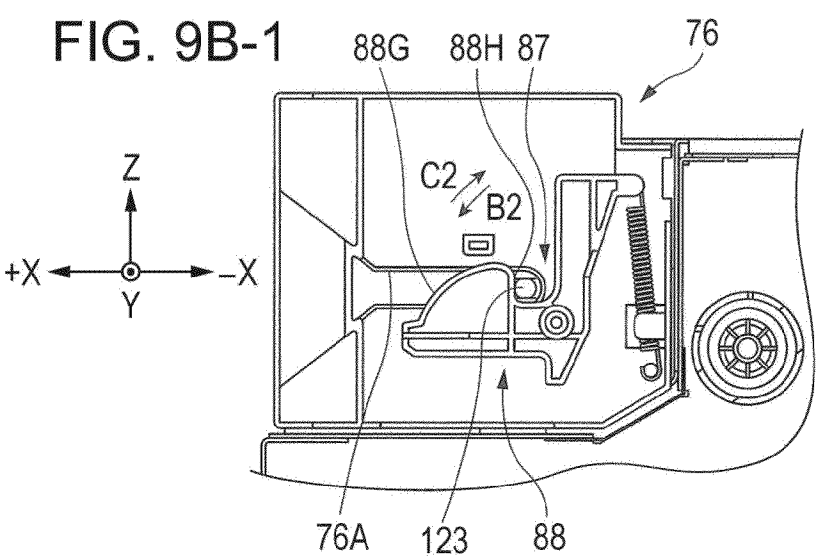
Figures 2, 9B:
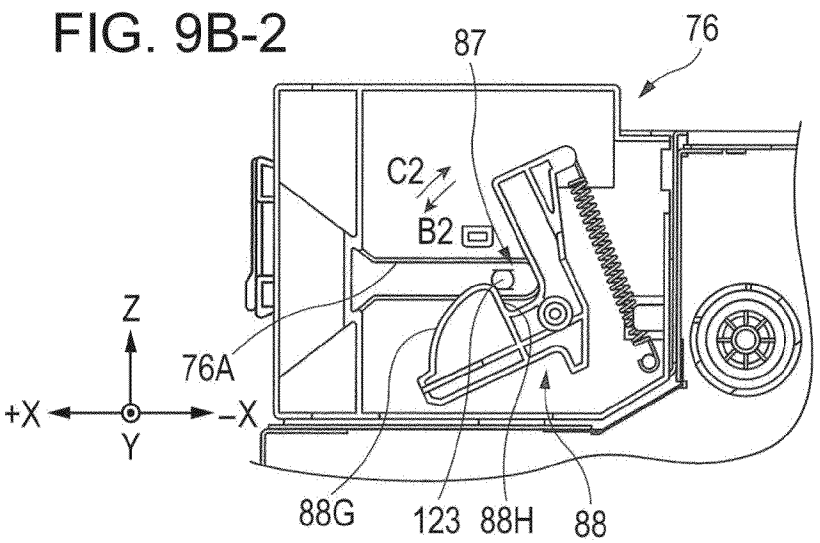
Figures 1, 9A:
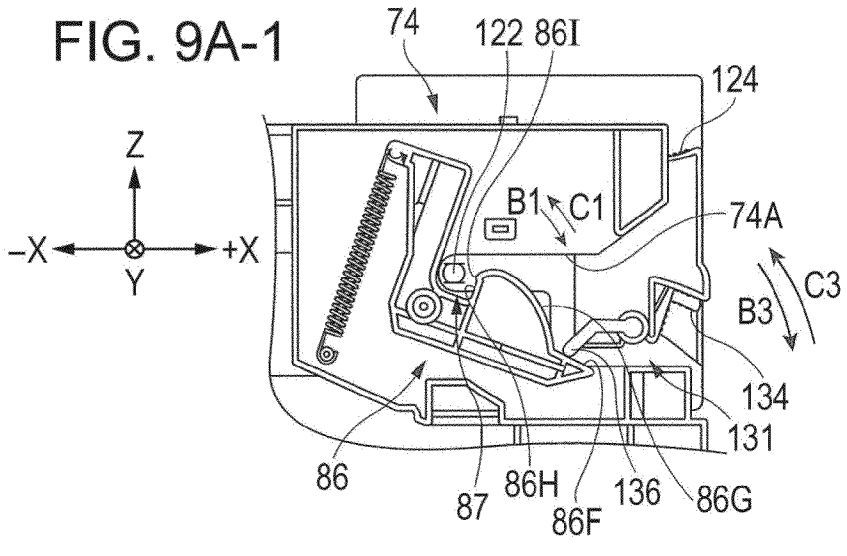
Figures 2, 9A:
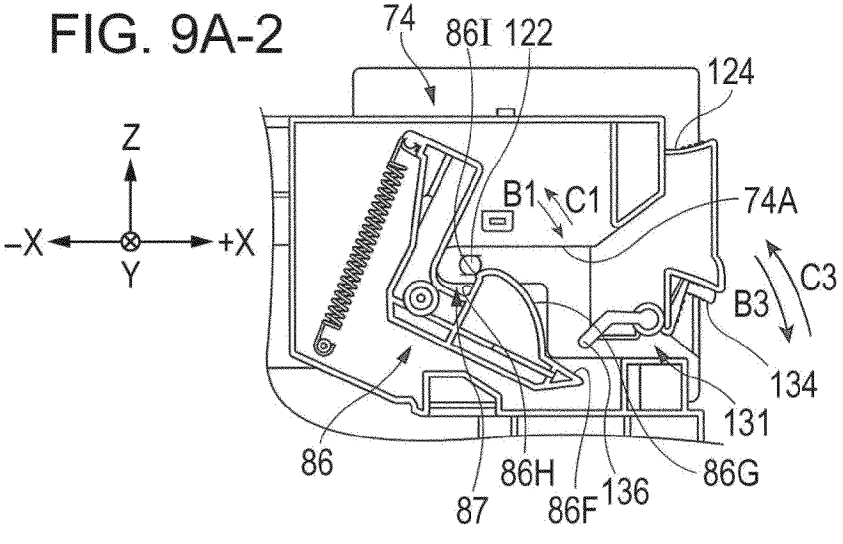
Figures 3, 9B:
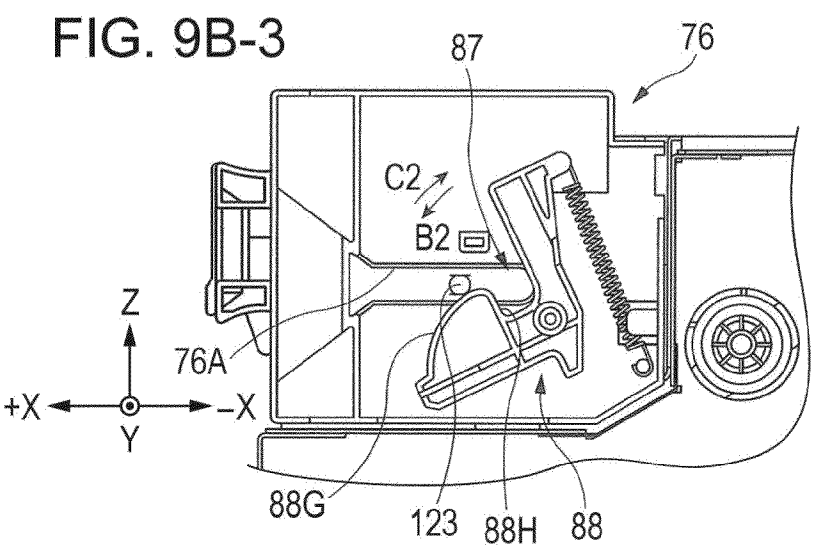
Figures 4, 9B:
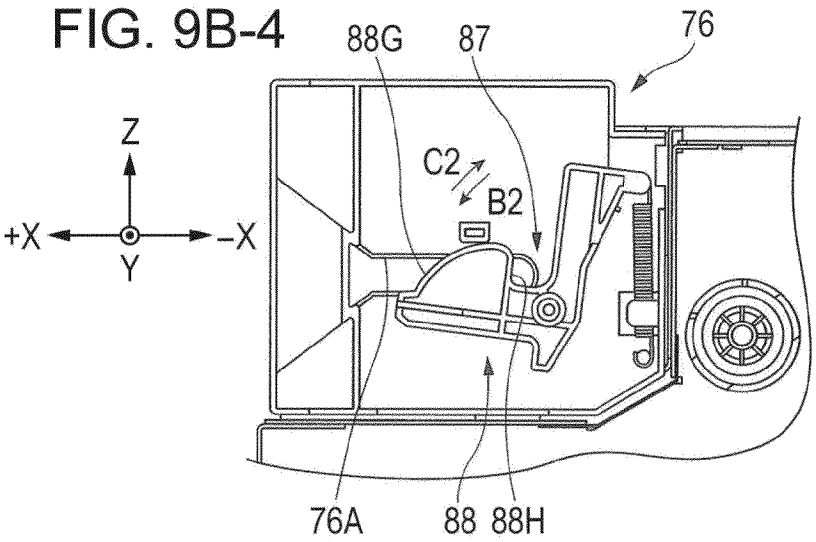
Figures 3, 9A:
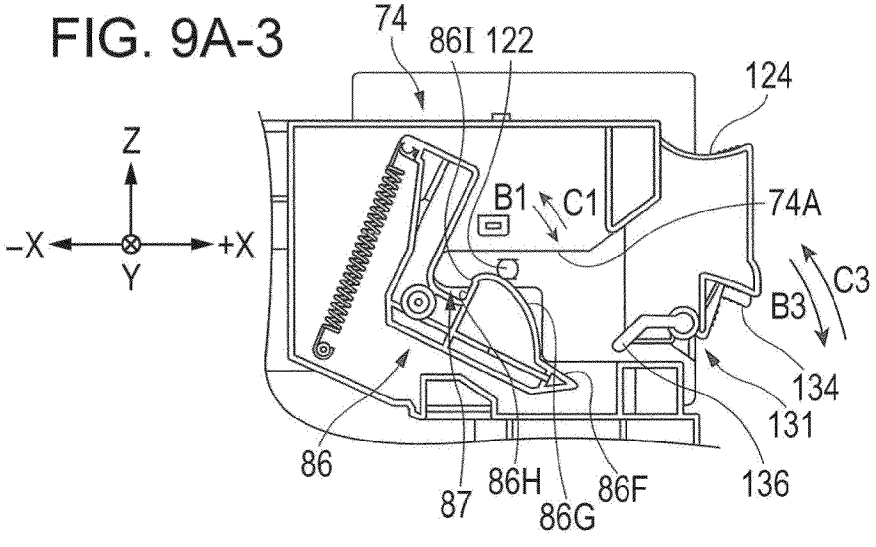
Figures 4, 9A:
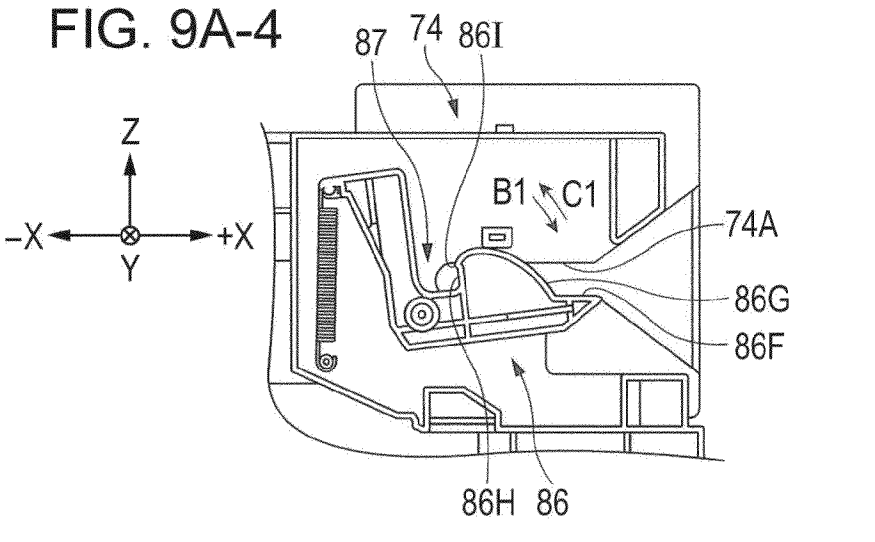

FIGS. 9A-1 to 9A-4 and 9B-1 to 9B-4 illustrate how the attaching/detaching mechanism 110 according to the exemplary embodiment of the present invention behaves in a detaching operation in which the fixing unit 100 is detached from the body 70A. FIGS. 9A-1 to 9A-4 illustrate the behavior of the attaching/detaching mechanism 110 on the connector side. FIGS. 9B-1 to 9B-4 illustrate the behavior of the attaching/detaching mechanism 110 on the drive side.

Referring to FIGS. 9A-1 and 9B-1, the user grips the grip 124 and the grip 125 (see FIG. 7A) so as to detach the fixing unit 100 from the body 70A. In this step, when the user grips the grip 124 provided on the connector side, the user also grips the operated portion 134 of the disabling lever 131 provided below the grip 124. Therefore, the disabling lever 131 rotates in the direction of arrow C3, and the acting portion 136 of the disabling lever 131 comes into contact with the contact surface 86F of the connector-side pressing member 86. Furthermore, the disabling lever 131 pushes the contact surface 86F downward against the urging force exerted by the tension spring 79. Consequently, the connector-side pressing member 86 rotates in the direction of arrow B1, and the guide pin 122 is spaced apart from the side surface 86H. In this state, the guide pin 123 provided on the drive side is in contact with the side surface 88H.

Referring to FIGS. 9A-2 and 9B-2, when the user pulls the fixing unit 100 in the +X direction while gripping the grip 124, the operated portion 134, and the grip 125 (see FIG. 7A), the guide pin 122 on the connector side that is moving in the +X direction goes over the projection 86I and comes into contact with an upper part of the guide surface 86G. Meanwhile, the guide pin 123 on the drive side that is moving in the +X direction moves along the side surface 88H of the drive-side pressing member 88 while pushing the side surface 88H and comes into contact with an upper part of the guide surface 88G.

Subsequently, referring to FIGS. 9A-3 and 9B-3, when the user further pulls the fixing unit 100 in the +X direction, the guide pins 122 and 123 that are moving in the +X direction move along the upper parts of the guide surfaces 86G and 88G, respectively. Furthermore, the connector-side pressing member 86 rotates in the direction of arrow C1, and the drive-side pressing member 88 rotates in the direction of arrow C2. Therefore, the guide pins 122 and 123 receive forces acting in the +X direction from the guide surfaces 86G and 88G, respectively. Furthermore, the connector 84 (see FIG. 2B) provided on the side of the body 70A and the connector 112 (see FIG. 6A) provided on the side of the fixing unit 100 are disconnected from each other.

Subsequently, referring to FIGS. 9A-4 and 9B-4, when the fixing unit 100 is further pulled in the +X direction, the fixing unit 100 is completely detached from the body 70A.

Behavior of Attaching/Detaching Mechanism 110 in Attaching Operation

How the attaching/detaching mechanism 110 behaves when the fixing unit 100 is attached to the body 70A will now be described.

Figures 1, 10B:
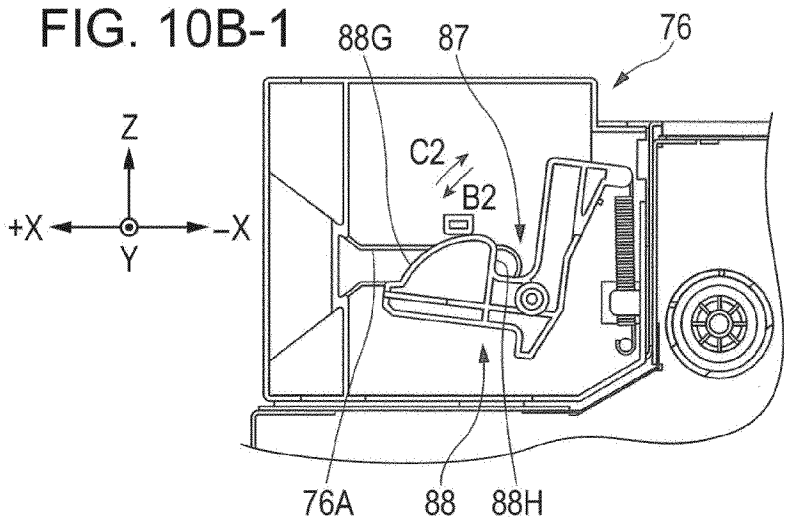
Figures 2, 10B:
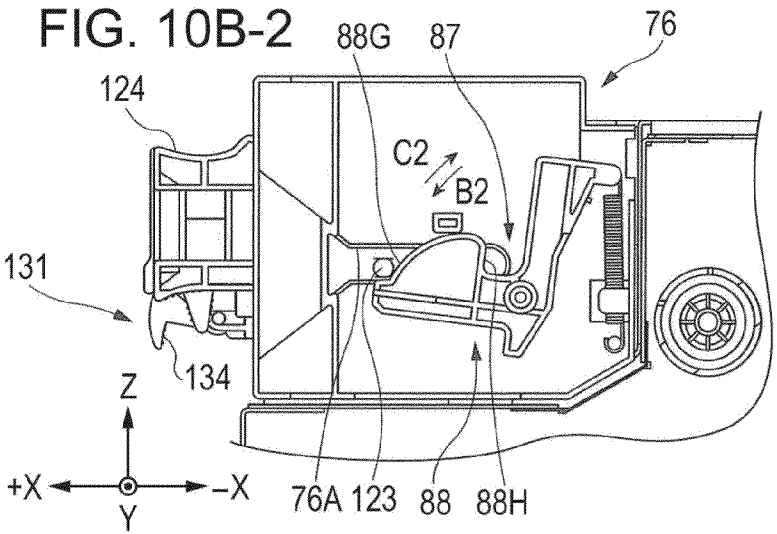
Figures 1, 10A:
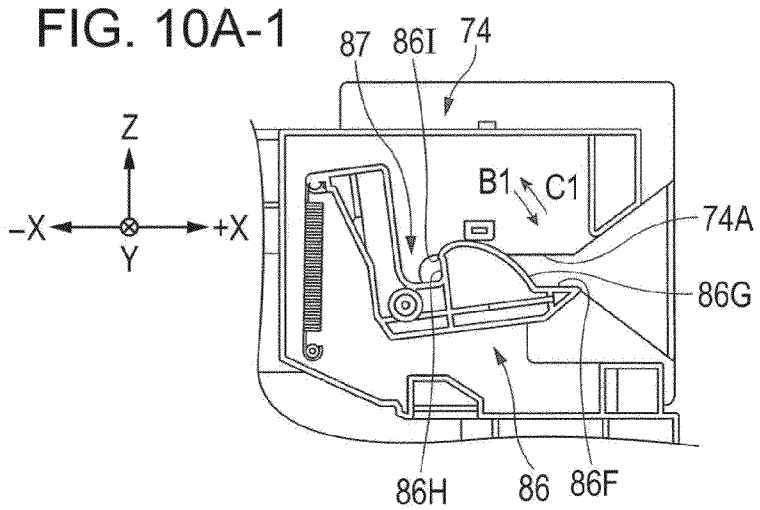
Figures 2, 10A:
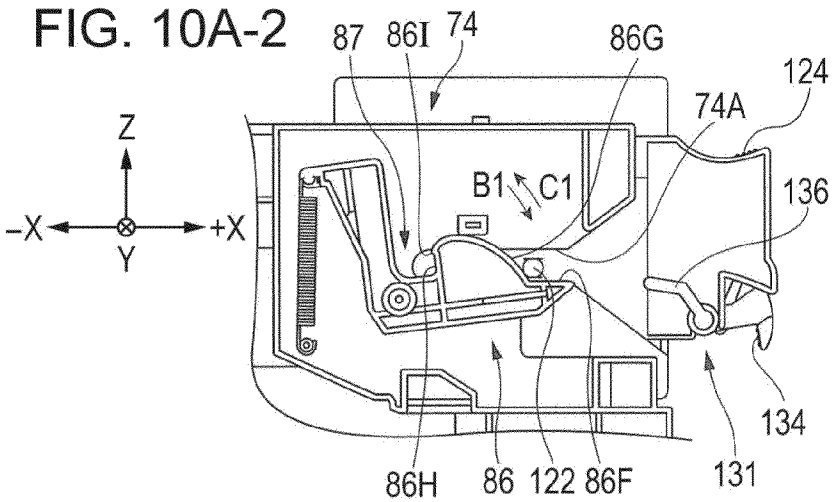
Figures 3, 10B:
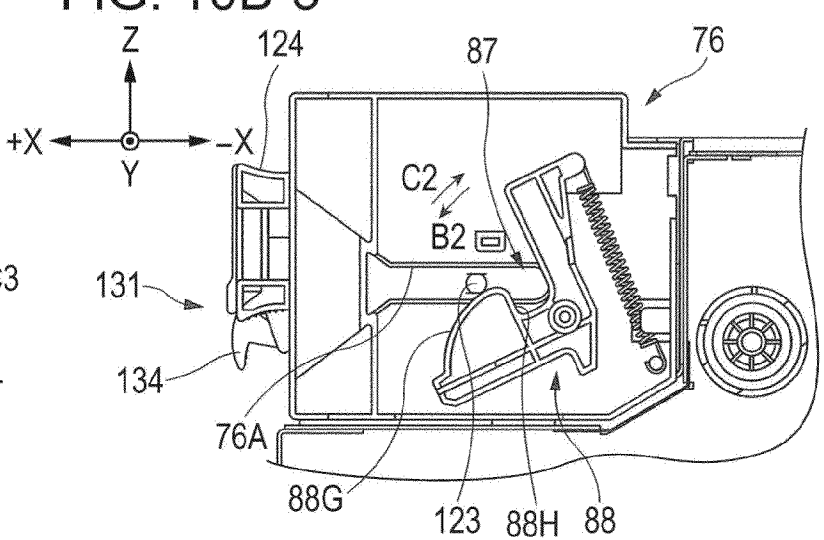
Figures 3, 10A:
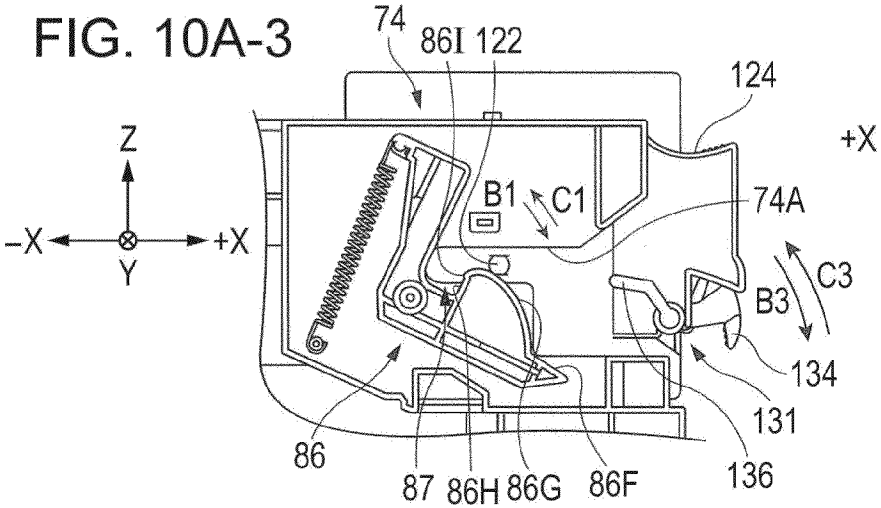
Figures 4, 10B:
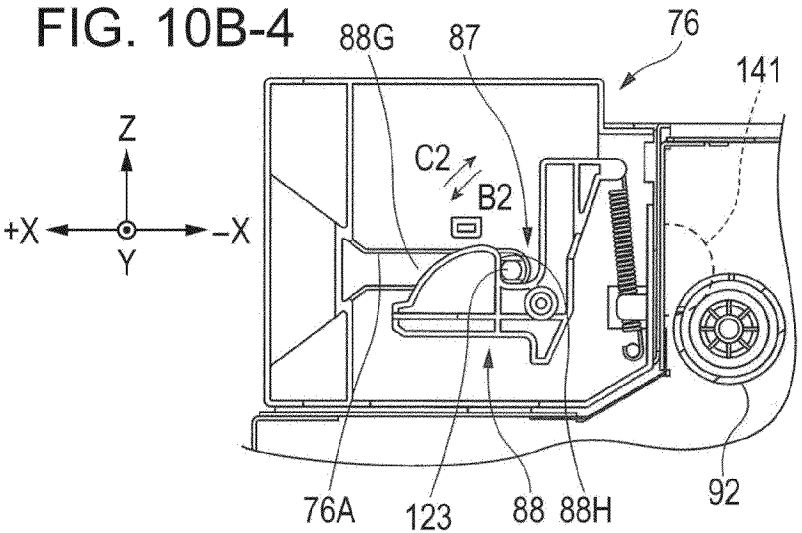
Figures 4, 10A:
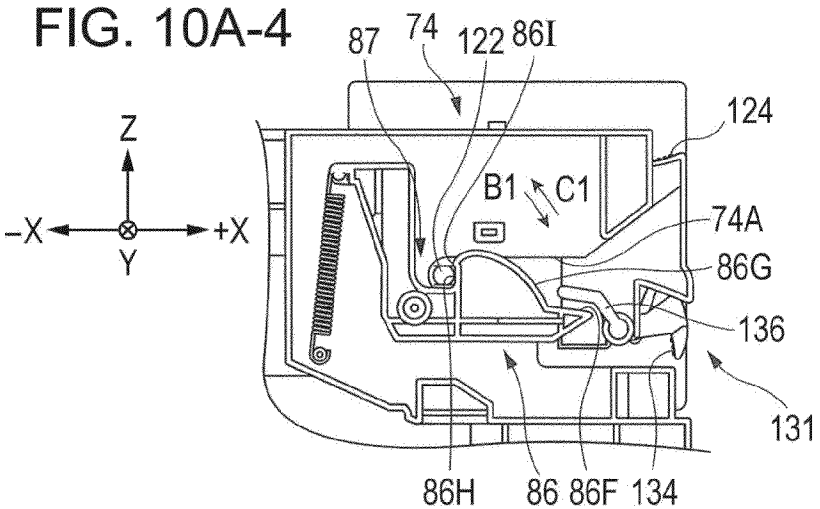

FIGS. 10A-1 to 10A-4 and 10B-1 to 10B-4 illustrate how the attaching/detaching mechanism 110 according to the exemplary embodiment of the present invention behaves in an attaching operation in which the fixing unit 100 is attached to the body 70A. FIGS. 10A-1 to 10A-4 illustrate the behavior of the attaching/detaching mechanism 110 on the connector side. FIGS. 10B-1 to 10B-4 illustrate the behavior of the attaching/detaching mechanism 110 on the drive side.

Referring to FIGS. 10A-1 and 10B-1, when the fixing unit 100 that has been detached from the body 70A is inserted into the body 70A, referring now to FIGS. 10A-2 and 10B-2, the guide pins 122 and 123 advance into the cut portions 74A and 76A, respectively, provided in the side plates 74 and 76 and the fixing unit 100 is thus guided in the −X direction. Furthermore, the guide pins 122 and 123 come into contact with the guide surfaces 86G and 88G, respectively.

Referring now to FIGS. 10A-3 and 10B-3, when the fixing unit 100 is further pushed into the body 70A (in the −X direction), the guide pins 122 and 123 that are moving in the −X direction push down the guide surfaces 86G and 88G, respectively. Consequently, the connector-side pressing member 86 having the guide surface 86G rotates in the direction of arrow B1, and the drive-side pressing member 88 having the guide surface 88G rotates in the direction of arrow B2.

When the fixing unit 100 is further pushed into the body 70A (in the −X direction), referring now to FIGS. 10A-4 and 10B-4, the guide pins 122 and 123 go over the upper parts of the guide surfaces 86G and 88G, respectively. Accordingly, the guide pins 122 and 123 no longer push the guide surfaces 86G and 88G. Consequently, the connector-side pressing member 86 rotates in the direction of arrow C1, and the drive-side pressing member 88 rotates in the direction of arrow C2. Furthermore, the guide pins 122 and 123 are pushed by the side surfaces 86H and 88H, respectively, and the contact surface 116A1 (see FIG. 6A) of the positioning pin 116A and the contact surface 116B1 (see FIG. 7A) of the positioning pin 116B come into contact with the positioning plate 72 (see FIG. 3B). Thus, the fixing unit 100 is positioned in the X direction.

With the above behavior of the attaching/detaching mechanism 110 in the attaching operation, the driving gear 92 provided on the side of the body 70A and the fixing-unit gear 141 provided on the side of the fixing unit 100 come to mesh with each other. In this state, referring to FIG. 10B-4, the axis of the driving gear 92 and the axis of the fixing-unit gear 141 are staggered from each other in a direction (the Z direction) intersecting (orthogonal to) the direction (the +X direction) in which the fixing unit 100 is pushed into the body 70A. Thus, the teeth of the driving gear 92 and the teeth of the fixing-unit gear 141 are prevented from bumping into and becoming out of mesh with each other.

Furthermore, with the above behavior of the attaching/detaching mechanism 110 in the attaching operation, the positioning pin 116A (see FIG. 6A) and the positioning pin 116B (see FIG. 7A) provided on the side of the fixing unit 100 are fitted into the oblong hole 82 and the opening 83 (see FIG. 3B), respectively, provided on the side of the body 70A, whereby the fixing unit 100 is positioned.

Removal of Recording Sheet S

An operation of removing any recording sheets S that have been stuck at the nip N (see FIG. 1) of the fixing unit 100 in times of jams (transport errors) will now be described.

Figure 11A:
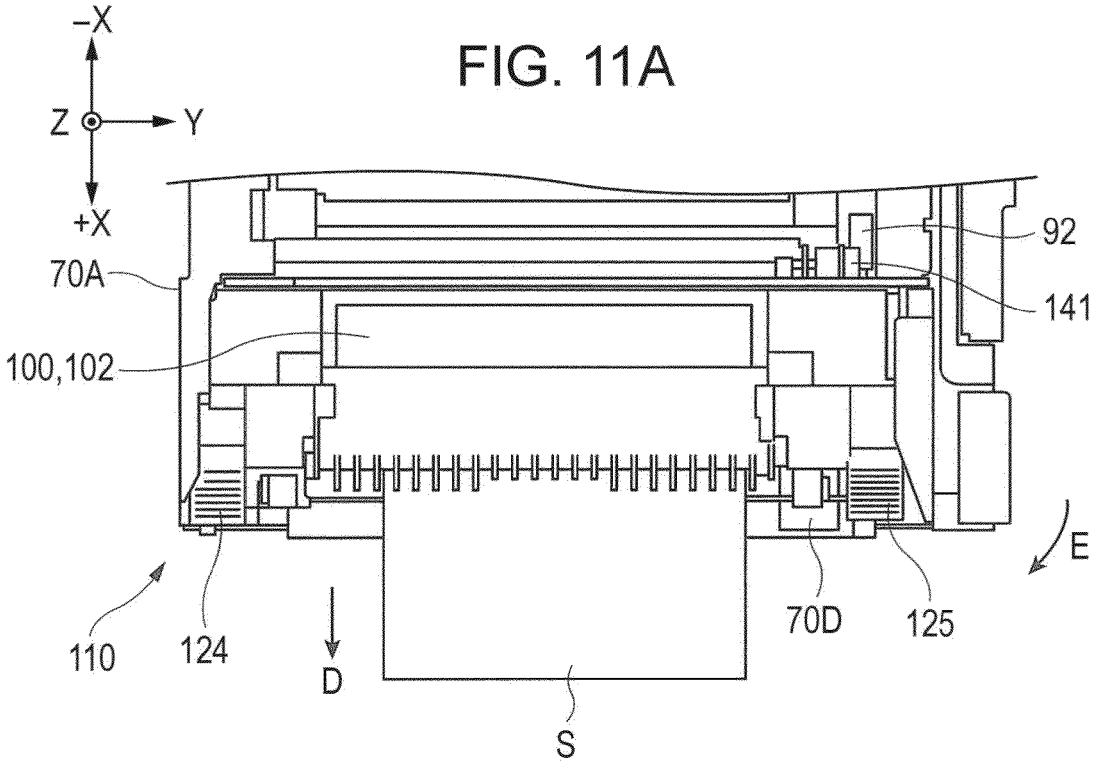
FIGS. 11A and 11B illustrate how the attaching/detaching mechanism according to the exemplary embodiment of the present invention behaves when a recording sheet is pulled out.
Figure 11B:
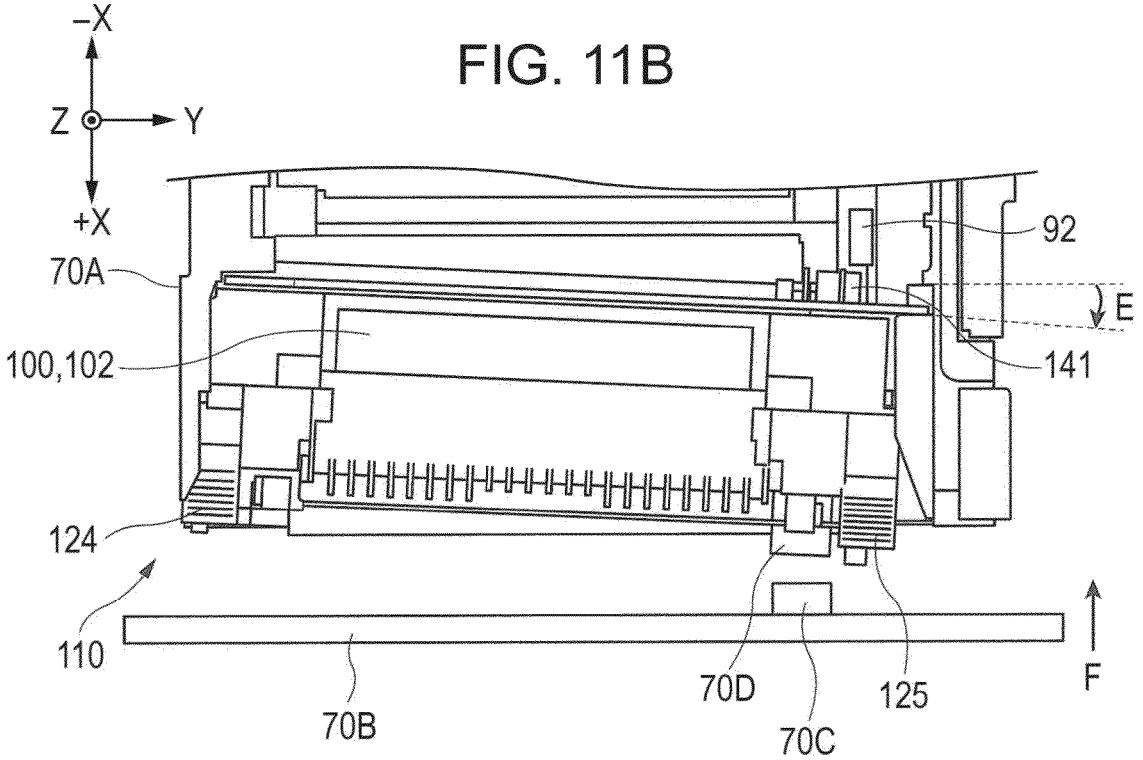

FIGS. 11A and 11B illustrate how the attaching/detaching mechanism 110 according to the exemplary embodiment of the present invention behaves when such a recording sheet S is pulled out. FIG. 11A is a top view illustrating the body 70A and the fixing unit 100 with a recording sheet S stuck at the nip N. FIG. 11B is a top view illustrating the body 70A and the fixing unit 100 in a state after the recording sheet S has been removed.

If a jam occurs and a recording sheet S gets stuck at the nip N (see FIG. 1) of the fixing unit 100 as illustrated in FIG. 11A, the user opens the covering 70B (see FIG. 1) and removes the recording sheet S.

To remove the recording sheet S (in a direction of arrow D) in such a state, the recording sheet S needs to be pulled out while the heat roller 104 and the pressure belt 106 (see FIG. 1) that form the nip N therebetween are caused to rotate. Moreover, if the fixing-unit gear 141, which drives the heat roller 104 and the pressure belt 106, is in mesh with the driving gear 92, the drive system provided on the side of the body 70A, including the driving gear 92 and the drive source that drives the driving gear 92, also needs to be rotated when the recording sheet S is pulled out. In such a situation, a force required to pull out the recording sheet S is larger than a force required to pull out the recording sheet S by rotating only the heat roller 104 and the pressure belt 106. Therefore, the removal of the recording sheet S is difficult.

In the attaching/detaching mechanism 110 according to the exemplary embodiment, when the user pulls the recording sheet S (in the direction of arrow D), the drive side of the fixing unit 100 moves in the +X direction while the connector side of the fixing unit 100 is prevented from moving, as illustrated in FIG. 11B. That is, the fixing unit 100 rotates about the connector side thereof (in the direction of arrow E), and the fixing-unit gear 141 goes out of mesh with the driving gear 92. In other words, the driving of the fixing-unit gear 141 by the driving gear 92 is disabled. Therefore, the recording sheet S is pulled out while only the heat roller 104 and the pressure belt 106 are caused to rotate. Thus, the load to be applied to the recording sheet S that is pulled out is reduced, and the removal of the recording sheet S becomes easier.

Referring now to FIGS. 12A-1, 12A-2, 12B-1, and 12B-2, how the attaching/detaching mechanism 110 behaves when the user pulls out the recording sheet S will be described.

Figures 1, 12B:
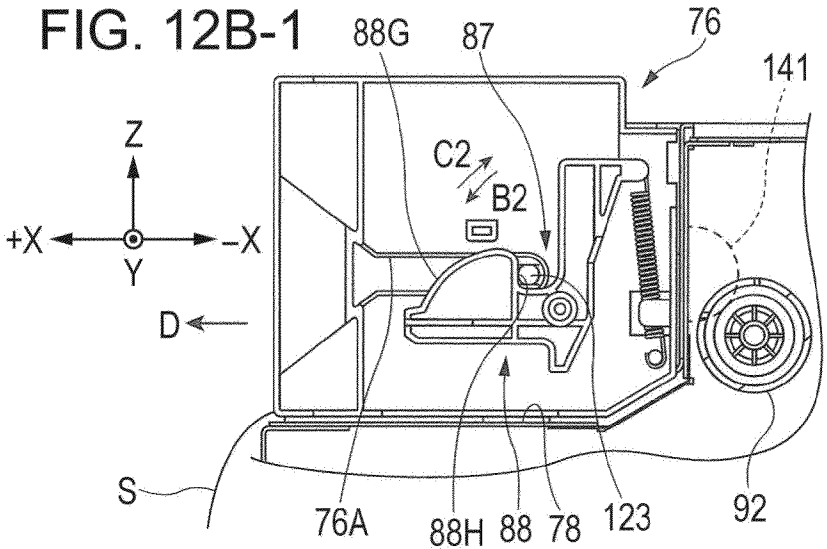
Figures 2, 12B:
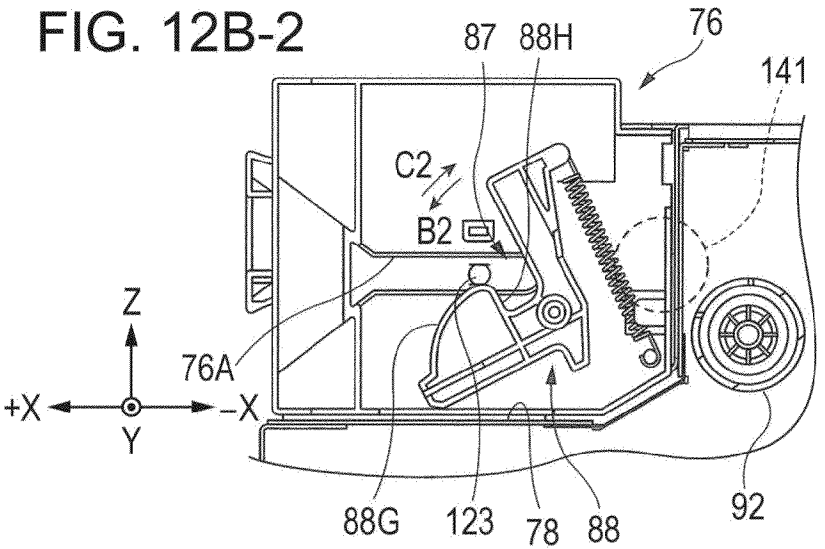
Figures 1, 12A:
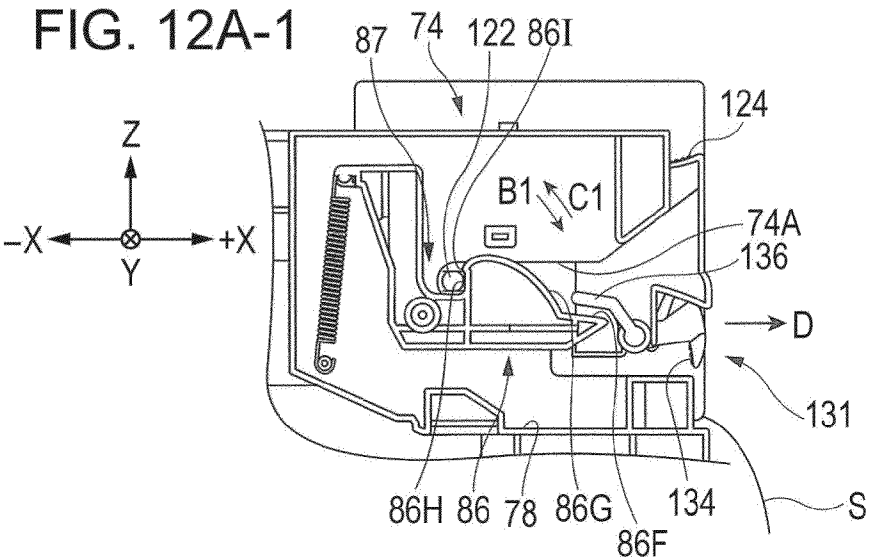
Figures 2, 12A:
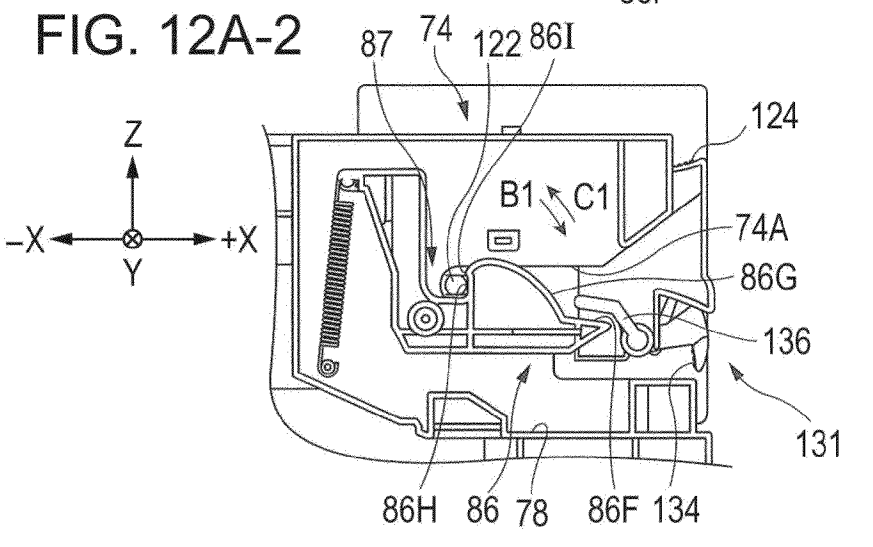

FIGS. 12A-1, 12A-2, 12B-1, and 12B-2 illustrate how the attaching/detaching mechanism 110 according to the exemplary embodiment of the present invention behaves when the recording sheet S is pulled out. FIGS. 12A-1 and 12A-2 illustrate the connector side of the attaching/detaching mechanism 110 seen in the +Y direction. FIGS. 12B-1 and 12B-2 illustrate the drive side of the attaching/detaching mechanism 110 seen in the −Y direction.

Referring to FIGS. 12A-1 and 12B-1, when a recording sheet S that has got stuck at the nip N (see FIG. 1) of the fixing unit 100 is pulled (in the direction of arrow D) with the attaching/detaching mechanism 110 being in the attached state, a force acting in the +X direction is applied to the fixing unit 100. Note that the grips 124 and 125 and the disabling lever 131 are not operated in this operation of pulling out the recording sheet S, unlike the operation of detaching the fixing unit 100 from the body 70A described above referring to FIGS. 9A-1 to 9A-4 and 9B-1 to 9B-4.

When the user pulls the recording sheet S, the guide pin 122 provided on the fixing unit 100 and facing the connector side of the attaching/detaching mechanism 110 tends to move in the +X direction. However, the guide pin 122 comes into contact with the projection 86I and is prevented from moving. Therefore, as illustrated in FIG. 12A-2, the connector-side pressing member 86 provided on the connector side keeps exerting the force acting in such a direction as to prevent the fixing unit 100 from being detached from the body 70A (the force that retains the fixing unit 100). Meanwhile, the guide pin 122 provided on the fixing unit 100 does not move from the position illustrated in FIG. 12A-1. In the state illustrated in FIG. 12A-2, the connector 84 (see FIG. 2B) of the body-side mechanism 120 and the connector 112 (see FIG. 6A) of the fixing unit 100 remain connected to each other.

In contrast, the attaching/detaching mechanism 110 does not have the projection 86I on the drive side thereof, as described above. Therefore, when the user pulls the recording sheet S, the guide pin 123 provided on the fixing unit 100 moves along the side surface 88H of the drive-side pressing member 88 while pushing the side surface 88H and comes into contact with the upper part of the guide surface 88G, as illustrated in FIG. 12B-2. Thus, the guide pin 123 provided on the fixing unit 100 moves in the +X direction by a predetermined length from the position illustrated in FIG. 12B-1.

As described above, when a force for pulling out the recording sheet S is applied to the attaching/detaching mechanism 110 according to the exemplary embodiment, only the drive side of the attaching/detaching mechanism 110 moves from the position thereof in the attached state while the connector side of the attaching/detaching mechanism 110 is prevented from moving. In such a situation, the connector-side pressing member 86 provided on the connector side keeps applying a force acting in the −X direction to the fixing unit 100. Therefore, the fixing unit 100 is prevented from dropping from the body 70A, or the fixing unit 100 as a whole is prevented from coming off of the body 70A. In the state illustrated in FIGS. 12A-2 and 12B-2, the fixing unit 100 remains supported by the guide plate 78.

Furthermore, as illustrated in FIGS. 11A and 11B, the attaching/detaching mechanism 110 allows the fixing unit 100 to rotate about the connector side thereof (in the direction of arrow E) with the force for pulling out the recording sheet S. As described above, the range in which the positioning pin 116A (see FIG. 6A) provided nearer to the center of rotation of the fixing unit 100 is movable in the Y direction within the oblong hole 82 (see FIG. 3B) is larger than the range in which the positioning pin 116B (see FIG. 7A) provided farther from the center of rotation of the fixing unit 100 is movable in the Y direction within the opening 83 (see FIG. 3B). Since the range of movement of the fixing unit 100 in the Y direction that is allowed by the attaching/detaching mechanism 110 differs with the distance from the center of rotation of the fixing unit 100, the attaching/detaching mechanism 110 is capable of positioning the fixing unit 100 without preventing the rotation of the fixing unit 100.

To prevent the rotation of the fixing unit 100 about the drive side thereof, any of the following is acceptable. For example, the positioning pin 116A (see FIG. 6A) or the positioning pin 116B (see FIG. 7A) may be configured to come into contact with the edge of the oblong hole 82 (see FIG. 3B) or the edge of the opening 83 (see FIG. 3B) with a rotation of the fixing unit 100 by a predetermined angle. For another example, contact portions (not illustrated) that are configured to come into contact with each other may be provided at the drive-side end of the fixing unit 100 and on the side plate 76, respectively, so that the fixing unit 100 is prevented from rotating about the drive side thereof.

In the state illustrated in FIG. 12A-2, the connector (see FIG. 2B) of the body-side mechanism 120 and the connector 112 (see FIG. 6A) of the fixing unit 100 remain connected to each other. Therefore, if the drive side of the fixing unit 100 is simply pushed into the body 70A after the user has removed the recording sheet S by pulling out the recording sheet S, the attaching/detaching mechanism 110 falls into the attached state without any other operations of connecting the connectors 84 and 112.

Furthermore, referring to FIG. 11B, a pressing portion 70C may be provided on a surface of the covering 70B that faces the fixing unit 100, and a pressed portion 70D may be provided at a position of the housing 102, which houses the fixing unit 100, that comes into contact with the pressing portion 70C when the covering 70B is closed. In such a configuration, when the covering 70B having been open is closed (in a direction of arrow F), the pressing portion 70C provided on the covering 70B presses the pressed portion 70D provided on the housing 102 in the −X direction. Consequently, the fixing unit 100 falls into the attached state.

Modifications

An attaching/detaching mechanism 210 according to a modification of the exemplary embodiment will now be described with reference to FIGS. 13A-1 to 13A-3 and 13B-1 to 13B-3.

Figures 1, 13B:
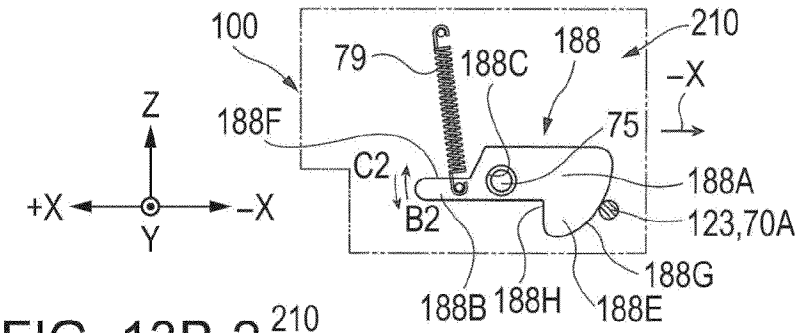
Figures 2, 13B:
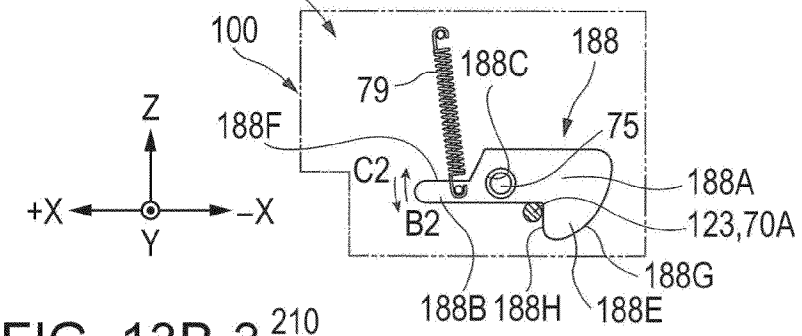
Figures 3, 13B:
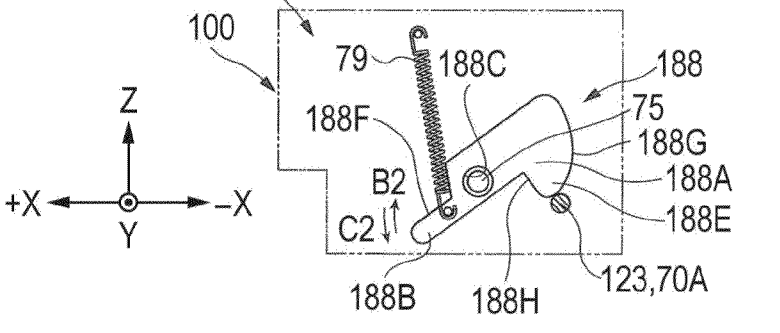
Figures 1, 13A:
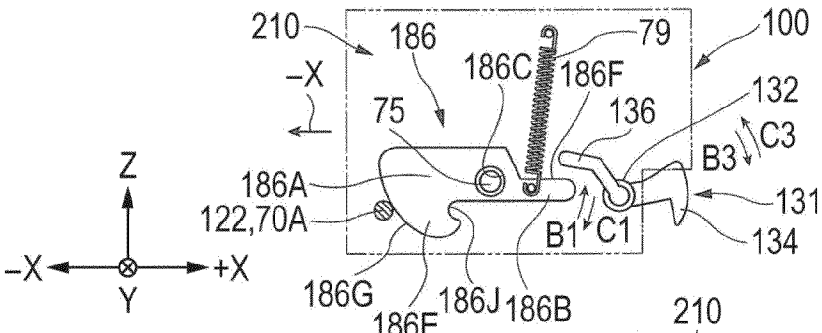
Figures 2, 13A:
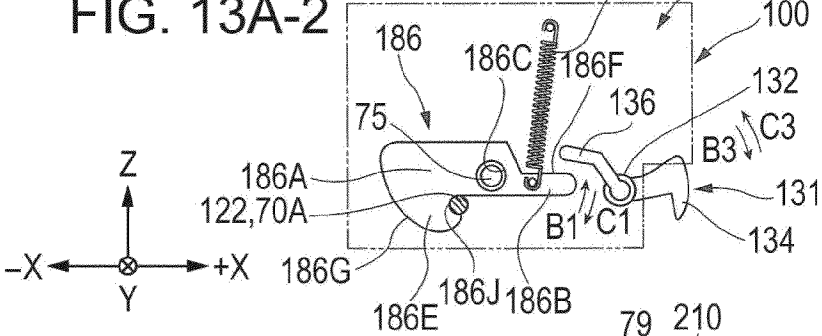
Figures 3, 13A:
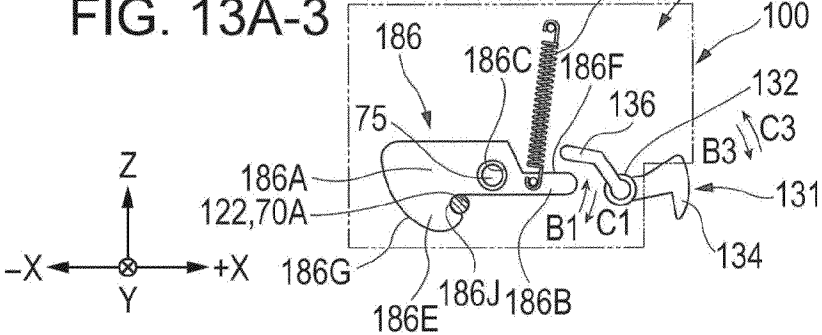

FIGS. 13A-1 to 13A-3 and 13B-1 to 13B-3 illustrate the attaching/detaching mechanism 210 according to the modification. FIGS. 13A-1 to 13A-3 illustrate the connector side of the attaching/detaching mechanism 210 according to the modification. FIGS. 13B-1 to 13B-3 illustrate the drive side of the attaching/detaching mechanism 210 according to the modification. Members that are the same as those of the attaching/detaching mechanism 110 are denoted by the same reference numerals as those used for the attaching/detaching mechanism 110, and description thereof is omitted.

The attaching/detaching mechanism 210 includes guide pins 122 and 123 provided on the body 70A. The attaching/detaching mechanism 210 further includes a connector-side pressing member 186 and a drive-side pressing member 188 that are provided on the fixing unit 100 and are engageable with the guide pins 122 and 123, respectively.

The connector-side pressing member 186 is a stick-type member whose longitudinal direction corresponds to the X direction. The connector-side pressing member 186 has a through hole 186C provided in an X-direction central part thereof. A portion of the connector-side pressing member 186 on the −X-direction side forms a first arm 186A. A portion of the connector-side pressing member 186 on the +X-direction side forms a second arm 186B.

The first arm 186A includes a latch 186E projecting from the lower surface of the first arm 186A in a direction intersecting (orthogonal to) the longitudinal direction of the first arm 186A. The latch 186E has a guide surface 186G projecting from the first arm 186A while forming an arc. The guide pin 122 comes into contact with the guide surface 186G. A recess 186J is provided at an end of the guide surface 186G nearer to the through hole 186C.

The second arm 186B has a contact surface 186F provided at an end thereof farther from the through hole 186C. The disabling lever 131 comes into contact with the contact surface 186F. One end of the tension spring 79 is hooked at a central part of the second arm 186B.

Similarly to the connector-side pressing member 186, the drive-side pressing member 188 is a stick-type member whose longitudinal direction corresponds to the X direction. The drive-side pressing member 188 has a through hole 188C provided in an X-direction central part thereof. A portion of the drive-side pressing member 188 on the −X-direction side forms a first arm 188A. A portion of the drive-side pressing member 188 on the +X-direction side forms a second arm 188B.

The first arm 188A includes a latch 188E projecting from the lower surface of the first arm 188A in a direction intersecting (orthogonal to) the longitudinal direction of the first arm 188A. The latch 188E has a guide surface 188G projecting from the first arm 188A while forming an arc. The guide pin 123 comes into contact with the guide surface 188G. A side surface 188H is provided at an end of the guide surface 188G nearer to the through hole 188C and extends in a direction intersecting (orthogonal to) the longitudinal direction of the second arm 188B. The side surface 188H is continuous with the guide surface 188G.

In attaching the fixing unit 100 to the body 70A, referring to FIGS. 13A-1 and 13B-1, the guide surface 186G of the connector-side pressing member 186 and the guide surface 188G of the drive-side pressing member 188 come into contact with the guide pins 122 and 123, respectively, provided on the body 70A, whereby the connector-side pressing member 186 and the drive-side pressing member 188 rotate (in the directions of arrows C1 and C2, respectively). Subsequently, the guide surfaces 186G and 188G go over the respective guide pins 122 and 123. Furthermore, the guide pin 122 on the connector side moves into the recess 186J while the guide pin 123 on the drive side comes into contact with the side surface 188H. Thus, the fixing unit 100 is set in the body 70A (see FIGS. 13A-2 and 13B-2).

In detaching the fixing unit 100 from the body 70A, the disabling lever 131 is rotated in the direction of arrow C3, whereby the guide pin 122 goes out of the recess 186J and comes into contact with the guide surface 186G. Accordingly, the guide pin 122 having been prevented from moving by the recess 186J is allowed to move. When the fixing unit 100 is moved in the +X direction in such a state, the latches 186E and 188E move over the respective guide pins 122 and 123. Thus, the fixing unit 100 is completely detached from the body 70A.

When a recording sheet S that is to be removed is pulled out, the disabling lever 131 is not operated and the fixing unit 100 receives a force acting in the +X direction. In such a situation, on the connector side of the attaching/detaching mechanism 210, the connector-side pressing member 186 of the fixing unit 100 tends to move in the +X direction but is prevented from moving because the guide pin 122 is caught by the recess 186J as illustrated in FIG. 13A-3. On the drive side of the attaching/detaching mechanism 210, the drive-side pressing member 188 of the fixing unit 100 moves while the side surface 188H thereof is pressed against the guide pin 123, and the guide pin 123 comes into contact with the guide surface 188G as illustrated in FIG. 13B-3. Accordingly, the drive side of the fixing unit 100 moves in the +X direction while the connector side of the fixing unit 100 is prevented from moving. That is, the fixing unit 100 rotates about the connector side thereof.

While the above description concerns a configuration in which the connector-side pressing member 86 has the projection 86I or a configuration in which the connector-side pressing member 186 has the recess 186J, the present invention is not limited to such configurations. The projection 86I or the recess 186J may alternatively be a step or the like provided in the side surface 86H, as long as the attaching/detaching mechanism 110 or 210 prevents the connector side of the fixing unit 100 from moving in the X direction in the operation of removing a recording sheet S without using the disabling lever 131.

Instead of providing the projection 86I on the connector-side pressing member 86, the tension springs 79 provided on the connector side and the drive side, respectively, may have different spring constant while the connector-side pressing member 86 and the drive-side pressing member 88 have the same configuration. Specifically, the spring constant of the tension spring 79 on the connector side may be made larger than that of the tension spring 79 on the drive side so that the tension spring 79 on the connector side is difficult to be stretched. In such a configuration also, in the operation of removing a recording sheet S, the attaching/detaching mechanism 110 allows the movement of the drive side of the fixing unit 100 while preventing the movement of the connector side of the fixing unit 100.

The above description concerns a case where the guide pin 122 has a substantially round columnar shape. Alternatively, the guide pin 122 may have any cross-sectional shape, such as an oval shape, a semicircular shape, a polygonal shape, or the like, as long as the guide pin 122 is movable along the guide surface 86G and the side surface 86H and is prevented from moving by coming into contact with the projection 86I.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body in which an image forming section that forms an image on a recording material and a drive mechanism that generates a rotational driving force are provided;

a fixing section that transports the recording material while receiving the rotational driving force and fixes the image on the recording material, the fixing section being held at a fixing position by the apparatus body at first and second axial ends thereof; and a transmission mechanism that is provided at the first axial end of the fixing section and is connected to the drive mechanism, the transmission mechanism transmitting the rotational driving force from the drive mechanism to the fixing section, wherein, in response to a pulling force being applied to the recording material while the recording material is present in the fixing section, the drive mechanism and the transmission mechanism are disconnected from each other and the fixing section moves away from the fixing position.

2. The image forming apparatus according to claim 1, wherein, in response to the pulling force being applied to the recording material while the recording material is present in the fixing section, the drive mechanism and the transmission mechanism are disconnected from each other while the second axial end of the fixing section is prevented from moving.

3. The image forming apparatus according to claim 2, further comprising a disabling mechanism that disables the prevention of the movement of the second axial end of the fixing section.

4. The image forming apparatus according to claim 1, further comprising:

a covering member that is openably and closably provided on the apparatus body, wherein, in response to closing the covering member that has been open, the transmission mechanism pushes the fixing section toward the apparatus body and the transmission mechanism is connected to the drive mechanism provided in the apparatus body.

5. The image forming apparatus according to claim 1, wherein the fixing section includes a connection terminal provided at the second axial end that is electrically connected to the apparatus body.

6. The image forming apparatus according to claim 1, wherein the drive mechanism and the transmission mechanism are disconnected from each other by moving the first axial end of the fixing section.

7. The image forming apparatus according to claim 1, wherein the drive mechanism and the transmission mechanism are disconnected from each other by moving the first axial end of the fixing section in a pulling out direction of the recording material.

8. The image forming apparatus according to claim 1, wherein the fixing section is coaxial with the transmission mechanism.

9. A fixing device detachably attached to an apparatus body that includes an image forming section that forms an image on a recording material and a drive mechanism that generates a rotational driving force, the fixing device transporting the recording material while receiving the rotational driving force, the fixing device being held at a fixing position by the apparatus body at first and second axial ends thereof, the fixing device comprising:

a transmission mechanism that is provided at the first axial end of the fixing device and connected to the drive mechanism, the transmission mechanism transmitting the rotational driving force from the drive mechanism to the fixing device, wherein, in response to a pulling force being applied to the recording material while the recording material is present in the fixing device, the drive mechanism and the transmission mechanism are disconnected from each other and the fixing device moves from fixing position.

10. The fixing device according to claim 9, wherein, in response to the pulling force being applied to the recording material while the recording material is present in the fixing device, the drive mechanism and the transmission mechanism are disconnected from each other while the second axial end of the fixing device is prevented from moving.

11. The fixing device according to claim 9, wherein the drive mechanism and the transmission mechanism are disconnected from each other by moving the first axial end of the fixing device.

12. The fixing device according to claim 9, wherein the drive mechanism and the transmission mechanism are disconnected from each other by moving the first axial end of the fixing device in a pulling out direction of the recording material.

13. An image forming apparatus comprising:

a fixing section that fixes an image on a recording material and includes first and second axial ends;

a transmission mechanism that is coaxial with the first axial end of the fixing section; and a drive mechanism that generates a rotational driving force for driving the fixing section using the transmission mechanism, wherein in response to a pulling force being applied to the recording material while the recording material is present in the fixing section, the fixing section and the transmission mechanism move so that the transmission mechanism is disengaged with the drive mechanism.

* * * * *